US008643564B2

(12) United States Patent
Shimayama et al.

(10) Patent No.: US 8,643,564 B2
(45) Date of Patent: Feb. 4, 2014

(54) TRIPLATE LINE INTER-LAYER CONNECTOR, AND PLANAR ARRAY ANTENNA

(75) Inventors: Yuuichi Shimayama, Chikusei (JP); Masahiko Oota, Chikusei (JP); Takashi Saitou, Chikusei (JP)

(73) Assignee: Hitachi Chemical Company, Ltd., Tokyo (JP)

( * ) Notice: Subject to any disclaimer, the term of this patent is extended or adjusted under 35 U.S.C. 154(b) by 663 days.

(21) Appl. No.: 12/869,158

(22) Filed: Aug. 26, 2010

(65) Prior Publication Data

US 2011/0050534 A1 Mar. 3, 2011

(30) Foreign Application Priority Data

Aug. 31, 2009 (JP) ..... 2009-199948
Mar. 30, 2010 (JP) ..... 2010-078130
Jun. 28, 2010 (JP) ..... 2010-145977

(51) Int. Cl.
*H01Q 1/50* (2006.01)

(52) U.S. Cl.
USPC ..... 343/850; 343/700 MS; 343/754; 333/246

(58) Field of Classification Search
USPC ..... 343/850, 700 MS, 754; 333/246
See application file for complete search history.

(56) References Cited

U.S. PATENT DOCUMENTS 6,023,210 A * 2/2000 Tulintseff ..... 333/238
6,545,572 B1 * 4/2003 Ohta et al. ..... 333/246
7,411,553 B2 * 8/2008 Oota et al. ..... 343/700 MS
8,253,511 B2 * 8/2012 Oota et al. ..... 333/26
2007/0229380 A1 10/2007 Oota et al.
2007/0241962 A1 10/2007 Shinoda et al.

FOREIGN PATENT DOCUMENTS

EP 1 420 267 5/2004
JP 11-261308 9/1999
WO WO 2006/098054 A1 9/2006

OTHER PUBLICATIONS

ChingJung Chen, Optimization of Aperture Transitions for Multiport Microstrip Circuits, Dec. 1996, IEEE Transactions on Microwave Theory and Techniques, vol. 44, No. 12, pp. 2457-2464.*
Chen , Optimization of Aperture Transitions for Multiport Microstrip Circuits, IEEE Transitions on Microwave Theory and Techniques, vol. 44, No. 12, Dec. 1, 19986, pp. 2457-2465.
Kim, An Improved Network Modeling of Slot-Coupled Microstrip Lines, IEEE Transitions on Microwave Theory and Techniques, vol. 46, No. 10, Oct. 1998, pp. 1484-1491.
EP Search Report Appln. No. 10173978.7 dated Dec. 10, 2010 in English.

* cited by examiner

*Primary Examiner* — Jerome Jackson, Jr.
*Assistant Examiner* — Hai Tran
(74) *Attorney, Agent, or Firm* — Antonelli, Terry, Stout & Kraus, LLP.

(57) ABSTRACT

A triplate line inter-layer connector and a planar array antenna are provided. The triplate line inter-layer connector has an electrical connection structure between a first triplate line and a second triplate line, a first patch pattern formed at a connection-side terminal end of a first feeder line, a first feed substrate having a first shield spacer disposed therebeneath, and a second shield spacer disposed thereabove. Each of the first and second shield spacers has a hollow portion hollowed out to a size encompassing the first feeder line and the first patch pattern so as to define a corresponding one of first and second dielectrics. A second feeder line is provided on a second feed substrate together with a second patch pattern, and a second ground conductor has a first slit formed in a portion thereof located approximately intermediate between the first and second patch patterns.

18 Claims, 30 Drawing Sheets

(a)

(b)

TRIPLATE LINE INTER-LAYER CONNECTOR, AND PLANAR ARRAY ANTENNA

FIELD OF THE INVENTION

The present invention relates to an inter-layer connection structure for layered triplate lines (triplate line inter-layer connection structure) in a millimeter-wave band. The present invention also relates to a planar array antenna compatible with emission/reception of signal waves in a millimeter-wave band and suitably usable for a vehicle-mounted radar.

BACKGROUND ART

As shown in FIG. 7, a conventional triplate line inter-layer connection structure is designed to allow a first triplate line in which a first feed substrate (06) provided with a first feeder line (05) and sandwiched between a first dielectric (04*a*) and a second dielectric (04*b*) disposed approximately intermediate between a first ground conductor (01) and a second ground conductor (02), and a second triplate line in which a second feed substrate (09) provided with a second feeder line (08) and sandwiched between a fifth dielectric (07*a*) and a sixth dielectric (07*b*) is disposed approximately intermediate between the second ground conductor (02) and a third ground conductor (03), to be electromagnetically coupled with each other through a slit (014) formed in the second ground conductor (02) (see a prior art structure in the following Patent Document 1).

Generally, with a view to suppressing a loss in the feeder line, a low-dielectric constant material having a relative permittivity $\in 1 \approx 1$ is used for the first dielectric (04*a*), the second dielectric (04*b*), the fifth dielectric (07*a*) and the sixth dielectric (07*b*). Further, with a view to avoiding the occurrence of a higher-order mode in the transmission line at an operating frequency, each of a distance between the first ground conductor (01) and the second ground conductor (02) and a distance between the second ground conductor (02) and the third ground conductor (03) is set to about ⅕ or less of an effective wavelength at the operating frequency (the effective wavelength=free-space wavelength/square root of relative permittivity of dielectric).

Further, as a prerequisite to allowing the first feeder line (05) and the second feeder line (08) to be electromagnetically coupled with each other through the second slit (014) in an adequate manner, it is necessary to configure the second slit (014) to resonate at the operating frequency. Therefore, as shown in FIG. 8, it is necessary that a resonator length L8, i.e., a length of the second slit (014), is set to about ½ of the effective wavelength at the operating frequency, and the second slit (014) is disposed to be located at a position away from each of a connection-side terminal end edge of the first feeder line (05) and a connection-side terminal end edge of the second feeder line (08) by a line length L7 equal to about ¼ of the effective wavelength at the operating frequency. Basically, a width of the second slit (014) is set to about 1/10 of the effective wavelength at the operating frequency.

As above, the resonator length L8 of the second slit (014) is set to about ½ of the effective wavelength at the operating frequency, so that the second slit (014) is operable to resonate at the operating frequency, and the setup position L7 of the second slit (014) away from each of the connection-side terminal end edges of the first feeder line (05) and the second feeder line (08) is set to about ¼ of the effective wavelength at the operating frequency, so that impedance matching dependent on a position the second slit (014) relative to the feeder lines is ensured to allow electromagnetic waves to be transmitted without being reflected.

In a planar array antenna for use in a vehicle-mounted radar and high-speed communications in a millimeter-wave band, it is important to have high-gain/wide-band characteristic and a capability to efficiently transmit received signals from a plurality of antennas to an electromagnetic-wave receiving/transmitting section so as to achieve required angle detection accuracy in a frequency band.

As a planar array antenna designed in view of the above point, the following Patent Document 2 discloses a low-cost planar antenna module which is low in loss and characteristic variation due to assembling errors, and stable in frequency characteristic. A structure of this planar array antenna module is shown in FIG. 5 and FIG. 7 of the Patent Document 2 (FIG. 26 and FIG. 27 of this application)

FIG. 5 of the Patent Document 2 (FIG. 26 of this application) shows an antenna section (101) which comprises an antenna substrate (40) formed with a plurality of antenna arrays each composed of a combination of a first feeder line (42) connected to a radiation element (41), and a first connection portion (43) electromagnetically coupled with a feeder section (the entirety of FIG. 27).

FIG. 7 of the Patent Document 2 (FIG. 27 of this application) shows the feeder section (102) and a second connection portion (52), wherein the first connection portion (43) in FIG. 26 and the second connection portion (52) in FIG. 27 are electromagnetically connected to each other via a second slot (24).

PRIOR ART DOCUMENT

Patent Document

[Patent Document 1] JP 3965762 B
[Patent Document 2] WO 2006/098054 A1

SUMMARY OF THE INVENTION

Problem to be Solved by the Invention

However, in the conventional inter-layer structure illustrated in FIG. 7, a resonance frequency largely varies due to an error in the resonator length L8 of the second slit (014), and an impedance dependent on a position of the second slit (014) relative to the feeder lines largely varies due to an error in the setup position L7 of the second slit (014) away from each of the connection-side terminal end edges of the first feeder line (05) and the second feeder line (08). This causes a problem that the frequency characteristic has a narrow band.

Moreover, along with the electromagnetic coupling between the first feeder line (05) and the second feeder line (08) through the second slit (014), parallel plate components are generated to be propagated between the first ground conductor (01) and the second ground conductor (02) and between the third ground conductor (03) and the second ground conductor (02), in a lateral direction, which causes a problem of an increase in loss.

In addition, if it is tried to achieve the above conventional triplate line inter-layer connection structure in an extremely high-frequency band, e.g., an operating frequency of 76.5 GHz band, the resonator length L8 and the width of the second slit (014) illustrated in FIG. 8 are set to extremely fine dimensions, for example, about 2 mm and about 0.4 mm or less, respectively. Thus, it becomes difficult to form the second slit (014) by mechanical press or the like, and it becomes necessary to, during assembling, set the setup position L7 of the second slit (014) away from each of the connection-side terminal end edges of the first feeder line (05) and the second feeder line (08), to about 1 mm with a high degree of accuracy. In other words, it is essential to select a highly-accurate slit-forming process and a highly-accurate assembling structure, which causes a problem of an increase in cost.

In a triplate line inter-layer connector disclosed in the Patent Document 2 which was invented to solve the above conventional problems, a patch pattern is provided at a terminal end of a feeder line to achieve an electrical connection between different layers, and a shield spacer is provided around the patch pattern to suppress a parallel plate component of electromagnetic waves. This structure has an advantage of being able to provide a triplate line inter-layer connector which is excellent in suppression of a transmission loss, and easy to be assembled. However, the patch pattern formed at the terminal end of the feeder line poses restrictions on a location for the inter-layer connection. Thus, in view of allowing the inter-layer connection to be desirably achieved at any position, a need for further improvement remains.

Furthermore, in conventional array antennas, it has been considered that it is preferable to provide a feedpoint to be positioned in an approximately central region of the antenna in a finally assembled state. This is because an adequate beam characteristic, e.g., a characteristic where a direction of a main beam is kept constant in a desired frequency range, can be obtained. However, if it is attempted to provide a feedpoint in a central region of an antenna using an inter-layer connector disclosed in the Patent Document 1, it is necessary, for example, to additionally provide a divider above the inter-layer connector to distribute electric power in two direction of the antenna, which causes a problem in terms of a design space and a production cost.

Specifically, in the triplate line inter-layer connector disclosed in the Patent Document 1, for example, as shown in FIG. 1, the first feeder line 5 and the second feeder line have a single-input and single-output relationship. Thus, in view of an input/output system, there remains a need for improvement in diversity.

Therefore, it is an object of the present invention to provide a triplate line inter-layer connector capable of obtaining a stable antenna frequency characteristic over a wide band in a more compact configuration than the conventional antenna. It is another object of the present invention to provide a triplate line inter-layer connector which has a low power loss, and high design flexibility allowing the inter-layer connection to be achieved at any position of a feed substrate.

Meanwhile, the connection portion (43) illustrated in FIG. 5 in the Patent Document 2 (FIG. 26 of this application) is formed in a quadrangular shape having a size approximately equal to that of the radiation element (41). Thus, it is necessary to avoid an undesirable influence of an interaction with the radiation element (41). For the sake of the avoidance, the connection portion (43) is provided at an end of the feeder line (42), or a lead wire from the feeder section (102) is provided and arranged. This causes a problem of deterioration in design flexibility required for meeting a recent need for reducing an area of an antenna substrate.

Moreover, as a prerequisite to sequentially feeding power from the connection portion (43) located at the end, to each of the radiation elements (41), a phase error during feeding is increased in proportion to a length of the feeder line. Particularly, in a wide frequency band such as UWB, there is a problem that it becomes more difficult to uniform a frequency characteristic in a beam direction. Further, when used for a vehicle-mounted radar, it is required to have excellent mass productivity.

It is therefore yet another object of the present invention to provide a planar array antenna capable of being efficiently produced, while achieving a low variation in beam direction within an operating frequency range even in a wide frequency band such as UWB (Ultra Wide Band), excellent suppression of an unwanted propagation mode in a terminal end of a transmission line, and a reduction in area of an antenna substrate.

Means for Solving the Problem

According to a first aspect of the present invention, there is provided a triplate line inter-layer connector which has an electrical connection structure between a first triplate line in which a first feed substrate (06) provided with a first feeder line (05) and sandwiched between a first dielectric (04*a*) and a second dielectric (04*b*) is located approximately intermediate between a first ground conductor (01) and a second ground conductor (02), and a second triplate line in which a second feed substrate (09) provided with a second feeder line (08) and sandwiched between a third dielectric (04*c*) and a fourth dielectric (04*d*) is located approximately intermediate between the second ground conductor (02) and a third ground conductor (03), wherein: the first feeder line (05) is provided on the first feed substrate (06) to extend from an input end (05*a*) thereof at an edge of the first feed substrate (06) to a first patch pattern (012*a*) which is formed at a connection-side terminal end of the first feeder line (05); the first feed substrate (06) has a first shield spacer (010*a*) disposed therebeneath, and a second shield spacer (010*b*) disposed just thereabove, wherein each of the first shield spacer (010*a*) and the second shield spacer (010*b*) has a hollow portion hollowed out to a size encompassing the first feeder line (05) and the first patch pattern (012*a*) so as to define a corresponding one of the first dielectric (04*a*) and the second dielectric (04*b*) in a respective one of the positions beneath and just above the first feed substrate (06); the second feeder line (08) is provided on the second feed substrate (09) together with a second patch pattern (012*b*) to extend in two directions from the second patch pattern (012*b*) to respective two output ends (08*a*, 08*b*) of the second feeder line (08); and the second ground conductor (02) has a first slit (013) formed in a portion thereof located approximately intermediate between the first patch pattern (012*a*) and the second patch pattern (012*b*), and wherein: the first slit (013) is configured such that a longitudinal direction thereof becomes approximately perpendicular to a longitudinal direction of the second patch pattern (012*b*); and the hollow portion (04*a*) of the first shield spacer (010*a*), the second patch pattern (012*b*), the hollow portion (04*b*) of the second shield spacer (010*b*), the first slit (013) and the second patch pattern (012*b*) have an overlap region, when viewed from the side of the third ground conductor (03) in a layered direction of the first and second triplate lines.

According to a second aspect of the present invention, there is provided a triplate line inter-layer connector which has an electrical connection structure between a first triplate line in which a first feed substrate (06) provided with a first feeder line (05) and sandwiched between a first dielectric (04*a*) and a second dielectric (04*b*) is located approximately intermediate between a first ground conductor (01) and a second ground conductor (02), and a second triplate line in which a second feed substrate (09) provided with a second feeder line (08) and sandwiched between a fifth dielectric (07*a*) and a sixth dielectric (07*b*) is located approximately intermediate between the second ground conductor (02) and a third ground conductor (03), wherein: the first feeder line (05) is provided on the first feed substrate (06) to extend from an input end (05*a*) thereof at an edge of the first feed substrate (06) to a first patch pattern (012*a*) which is formed at a connection-side terminal end of the first feeder line (05); the first feed substrate (06) has a first shield spacer (010*a*) disposed therebeneath, and a second shield spacer (010*b*) disposed just thereabove, wherein each of the first shield spacer (010*a*) and the second shield spacer (010*b*) has a hollow portion hollowed out to a size encompassing the first feeder line (05) and the first patch pattern (012*a*); the second feeder line (08) is provided on the second feed substrate (09) together with a second patch pattern (012*b*) to extend in two directions from the second patch pattern (012*b*) to respective two output ends (08*a*, 08*b*) of the second feeder line (08); a third shield spacer (011*a*) and a fourth shield spacer (011*b*) disposed to allow the fifth dielectric (07*a*) and the sixth dielectric (07*b*) to be located at respective positions beneath and just above the second feeder line (08) and the second patch pattern (012*b*), wherein each of the third shield spacer (011*a*) and the fourth shield spacer (011*b*) is adapted to define a dielectric which has a size encompassing the second feeder line (08) and the second patch pattern (012*b*) and extends between opposite ends in a line direction of the second feeder line (08); and the second ground conductor (02) has a first slit (013) formed in a portion thereof located approximately intermediate between the first patch pattern (012*a*) and the second patch pattern (012*b*), and wherein; the first slit (013) is configured such that a longitudinal direction thereof becomes approximately perpendicular to a longitudinal direction of the second patch pattern (012*b*); and the hollow portion (04*a*) of the first shield spacer (010*a*), the second patch pattern (012*b*), the hollow portion (04*b*) of the second shield spacer (010*b*), the first slit (013) and the second patch pattern (012*b*) have an overlap region, when viewed from the side of the third ground conductor (03) in a layered direction of the first and second triplate lines.

Preferably, in the triplate line inter-layer connector according to the first or second aspect of the present invention, the first patch pattern has, in a line direction of the associated feeder line, a length L1 which is about ¼ to ½ times greater than an effective wavelength λg at an operating frequency, and a part of the hollow portion hollowed out to a size encompassing the first patch pattern, in each of the first shield spacer (010*a*) and the second shield spacer (010*b*), has, in a line direction of the associated feeder line, a length L2 which is about 0.6 times greater than the effective wavelength λg at the operating frequency. Further, it is preferable that the second patch pattern has, in a line direction of the associated feeder line, a length L3 which is 0.35 to 0.5 times greater than the effective wavelength λg at the operating frequency, and the first slit (013) has, in a direction perpendicular to the longitudinal direction of the second patch pattern (012*b*), a length LS4 which is 0.4 to 0.6 times greater than the effective wavelength λg at the operating frequency.

Preferably, in the triplate line inter-layer connector according to the first or second aspect of the present invention, the first patch pattern is formed in a circular shape having a diameter L4 which is about ¼ to ½ times greater than an effective wavelength λg at an operating frequency, and a part of the hollow portion hollowed out to a size encompassing the first patch pattern, in each of the first shield spacer (010*a*) and the second shield spacer (010*b*), is formed in a circular shape having a diameter L5 which is about 0.6 times greater than the effective wavelength λg at the operating frequency.

Further, the inventors have devoted themselves to studies to achieve the above objects. Generally, a change in propagation mode causes a propagation loss. Thus, in an initial stage, the inventors sought a solution based on prevention of the change in propagation mode. As the first attempt, a size of the connection portion (43) in the Patent Document 2 was reduced. However, it was proven that the technique of simply reducing the size of the connection portion (43) causes undesirable deterioration in electromagnetic coupling effect, and a reduction in area of an antenna substrate cannot be achieved due to the presence of the connection portion (43) even after being reduced in size. Then, a structure free of the connection portion (43) was studied. Consequently, the study was carried out with a focus on a system in which a feeder line is used as substitute for a transmission line in the connection portion, and electromagnetically coupling through a slit is employed in at least one end of the transmission line. In this system, in view of propagation loss and accuracy in positioning between the slit and the transmission line, at least one end of a transmission line was formed as a patch pattern which has, in a longitudinal direction of a feeder line, a length equal to about ¼ to ½ of an effective wavelength, and two shield spacers each formed with a hollow portion surrounding (encompassing) the parch pattern, i.e., having a size larger than the patch pattern, at a position corresponding to the patch pattern, were provided at respective positions just above and beneath the transmission line. As a result, it was found out that the above structure can suppress a propagation loss while facilitating the positioning and provide a planar array antenna excellent in production efficiency. Based on this knowledge, the present invention has been accomplished.

Specifically, according to a second aspect of the present invention, there is provided a planar array antenna which has a multi-layer structure comprising an antenna section and a transmission line section, wherein: the antenna section includes an antenna substrate and a first ground conductor having a slit, wherein the antenna substrate has an antenna region which comprises a radiation element array consisting of a plurality of radiation elements arranged approximately in one line, and a feeder line connected to the respective radiation elements of the radiation element array; and the transmission line section includes a first shield spacer, a transmission line substrate, a second shield spacer and a second ground conductor, which are arranged in this order, wherein the transmission line substrate has a transmission line, and a patch pattern formed at least one end of the transmission line to have a width greater than that of the transmission line, and wherein: the feeder line, the slit and the patch pattern are provided at respective positions approximately corresponding to each other in a thicknesswise direction of the planar array antenna; respective shapes and positions of the slit and the feeder line are adjusted to satisfy the following relation: d1<d2, where d1 is a maximum distance of an overlap region between the slit and the feeder line in a longitudinal direction of the feeder line, and d2 is a distance between two straight lines which extend parallel to the longitudinal direction of the feeder line to sandwich the slit therebetween; the patch pattern has, in the longitudinal direction of the feeder line, a length which is about ¼~½ of an effective wavelength (λg); the first shield spacer has a hollow portion formed to surround the patch pattern; and the second shield spacer has a hollow portion formed in approximately the same shape as that of the hollow portion of the first shield spacer and at a position corresponding to the hollow portion of the first shield spacer.

Based on having the above configuration, it becomes possible to suppress an unwanted propagation mode in a terminal end of the transmission line even if the slit is used, while reducing a variation in beam direction within an operating frequency range even in a wide frequency band such as UWB, and provide an antenna substrate having a small area and excellent production efficiency.

Preferably, the planar array antenna of the present invention is configured such that, in an overlap region between the feeder line and the slit formed when viewed in the thickness-wise direction of the planar array antenna, the longitudinal direction of the feeder line becomes approximately perpendicular to a straight line connecting a1 and a2, where: a1 is a midpoint of a straight line which connects an intersection point e between a first one of opposite outer edges of the feeder line extending in the longitudinal direction thereof and a first one of opposite outer edges of the slit, and an intersection point f between the first outer edge of the feeder line and the other, second, outer edge of the slit; and a2 is a midpoint of a straight line which connects an intersection point h between the other, second, outer edge of the feeder line and the first outer edge of the slit, and an intersection point g between the second outer edge of the feeder line and the second outer edge of the slit. This configuration has an advantage of being able to transmit a propagation mode to the feeder line with high efficiency.

Preferably, in the planar array antenna of the present invention, the overlap region between the feeder line and the slit is located in a position where the number of a first group of the radiation elements connected to the feeder line on one side of the overlap region becomes equal to the number of a second group of the radiation elements connected to the feeder line on the other side of the overlap region. This configuration has an advantage of being able to reduce a variation in beam direction within an operating frequency range.

More preferably, in the above planar array antenna, the radiation elements are arranged to satisfy the following relation: b1+(a length equal to ½ of a wavelength λ at an operating frequency)≈b2, where: b1 is a length of the feeder line between a center point of the overlap region between the feeder line and the slit in the longitudinal direction of the feeder line and one of the first group of radiation elements located at the n-th position from the center point; and b2 is a length of the feeder line between the center point and one of the second group of radiation elements located at the n-th position from the center point. This configuration has an advantage of being able to obtain a high-gain planar array antenna.

As used herein, the symbol "≈" means to include an arrangement where b1+λ/2=b2, and an arrangement having a certain level of error to an extent that the advantageous effect of reducing the variation and providing the high gain is not spoiled. In other words, most preferably, b1+λ/2=b2. Further, the term "center point" means a midpoint of the aforementioned straight line connecting a1 and a2, and the length is measured on the basis of a line passing through a midpoint of a line width of the feeder line.

Preferable, the planar array antenna of the present invention comprises a feed segment which is formed to have a width greater than that of the feeder line, and provided on the feeder line in the overlap region between the feeder line and the slit. This configuration has an advantage of being able to facilitate impedance matching between an impedance of a high-frequency signal from the transmission line and an impedance of the feeder line.

Preferably, the planar array antenna of the present invention comprises a second dielectric, and a third ground conductor having a slot opening larger than each of the radiation elements at a position corresponding to the radiation element array, wherein the second dielectric and the third ground conductor are arranged in this other on the side of the radiation element array and the feeder line provided on the antenna substrate. This configuration has an advantage of being able to reduce interference with a high-frequency signal from an adjacent antenna and obtain a high gain.

Preferably, in the planar array antenna of the present invention, the antenna substrate has a plurality of rows of the antenna regions. This configuration has an advantage of being able to obtain a planar array antenna having higher detection accuracy.

More preferably, the above planar array antenna comprises third and fourth shield spacers provided at respective positions just above and beneath the antenna substrate having the plurality rows of antenna regions, wherein each of the third and fourth shield spacers has a plurality of hollow portions approximately corresponding to respective ones of the rows of antenna regions. This configuration has an advantage of being able to improve isolation between adjacent ones of the rows of antenna regions.

More preferably, in the above planar array antenna, the antenna substrate having the rows of antenna regions has a metal zone provided between adjacent ones of the rows of antenna regions. This configuration has an advantage of being able to further improve the isolation.

Preferably, the planar array antenna of the present invention comprises a first dielectric provided between the antenna substrate and the first ground conductor. This configuration has an advantage of being able to use a material other than that of the antenna substrate as a dielectric to be provided between the antenna substrate and the first ground conductor, to increase flexibility in material design.

Preferably, in the planar array antenna of the present invention, the slit has a quadrangular shape or oval shape. This configuration has an advantage of being able to induce resonance at an operating frequency to efficiently transmit a high-frequency signal.

Preferably, in the planar array antenna of the present invention, the second shield spacer has a thickness approximately equal to that of the first shield spacer. This configuration has an advantage of being able to enhance a high-frequency signal propagation characteristic.

Preferably, in the planar array antenna of the present invention, the first shield spacer has a thickness greater than that of the patch pattern. This configuration has an advantage of being able to reliably reduce a propagation loss of a high-frequency signal in the first patch pattern.

The planar array antenna of the present invention may be adapted to be used as a vehicle-mounted radar. The planar array antenna having the above configuration has a high gain, an excellent isolation capability, a small area and an excellent productivity, so that it is suitable for use as a vehicle-mounted radar.

Effect of the Invention

As above, the present invention can provide a triplate line inter-layer connector capable of obtaining a stable antenna frequency characteristic over a wide band in a more compact configuration than the conventional antenna, and can provide a triplate line inter-layer connector which has a low power loss, and high design flexibility allowing the inter-layer connection to be achieved at any position of a feed substrate.

The present invention can also provide a planar array antenna capable of being efficiently produced, while achieving a low variation in beam direction within an operating frequency range even in a wide frequency band such as UWB, excellent suppression of an unwanted propagation mode in a terminal end of a transmission line, and a reduction in area of an antenna substrate based on downsizing of an antenna region or high-density integration of a plurality of rows of antenna regions.

BRIEF DESCRIPTION OF THE DRAWINGS

FIG. 3 illustrates a triplate line inter-layer connector according to one embodiment of the present invention, wherein: FIG. 3(*a*) is a sectional view of the triplate line inter-layer connector; FIG. 3(*b*) and FIG. 3(*c*) are top plan views of two components of the triplate line inter-layer connector; and FIG. 3(*d*) is a top plan view of another component of the triplate line inter-layer connector.

FIG. 4(*b*) and FIG. 4(*c*) are top plan views of two components of the triplate line inter-layer connector; and FIG. 4(*d*) is a top plan view of another component of the triplate line inter-layer connector.

DESCRIPTION OF THE PREFERRED EMBODIMENTS

[Triplate Line Inter-Layer Connector According to the Present Invention]

As each of a ground conductor and a shield spacer to be used in a triplate line inter-layer connector according to the present invention, any type of metal plate or a plastic plate subjected to plating may be employed. In particular, it is preferable to employ an alumina plate, because a lightweight and low-cost ground conductor or shield spacer can be prepared.

Alternatively, each of the ground conductor and the shield spacer may be prepared by laminating a copper foil on a film as a base material to obtain a flexible substrate and removing an unnecessary part of the copper foil from the flexible substrate by etching, or may be prepared using a copper-cladded laminate formed by laminating a copper foil on a thin resin sheet consisting of a glass cloth impregnated with resin.

As a dielectric, a foamed material having a low relative permittivity may be preferably employed. In this case, a relative permittivity of the dielectric can be considered as a relative permittivity of air in the foamed material. Alternatively, a space itself defined by a spacer or the like may be preferably employed as the dielectric (the space will be filled with air at a barometrical pressure during a production process).

An antenna circuit substrate may be prepared by laminating a copper foil on a film as a base material to obtain a flexible substrate, and removing an unnecessary part of the copper foil from the flexible substrate by etching to form a radiation element and a feeder line thereon. Alternatively, the antenna circuit substrate may be prepared using a copper-cladded laminate formed by laminating a copper foil on a thin resin sheet consisting of a glass cloth impregnated with resin.

Figure 3:
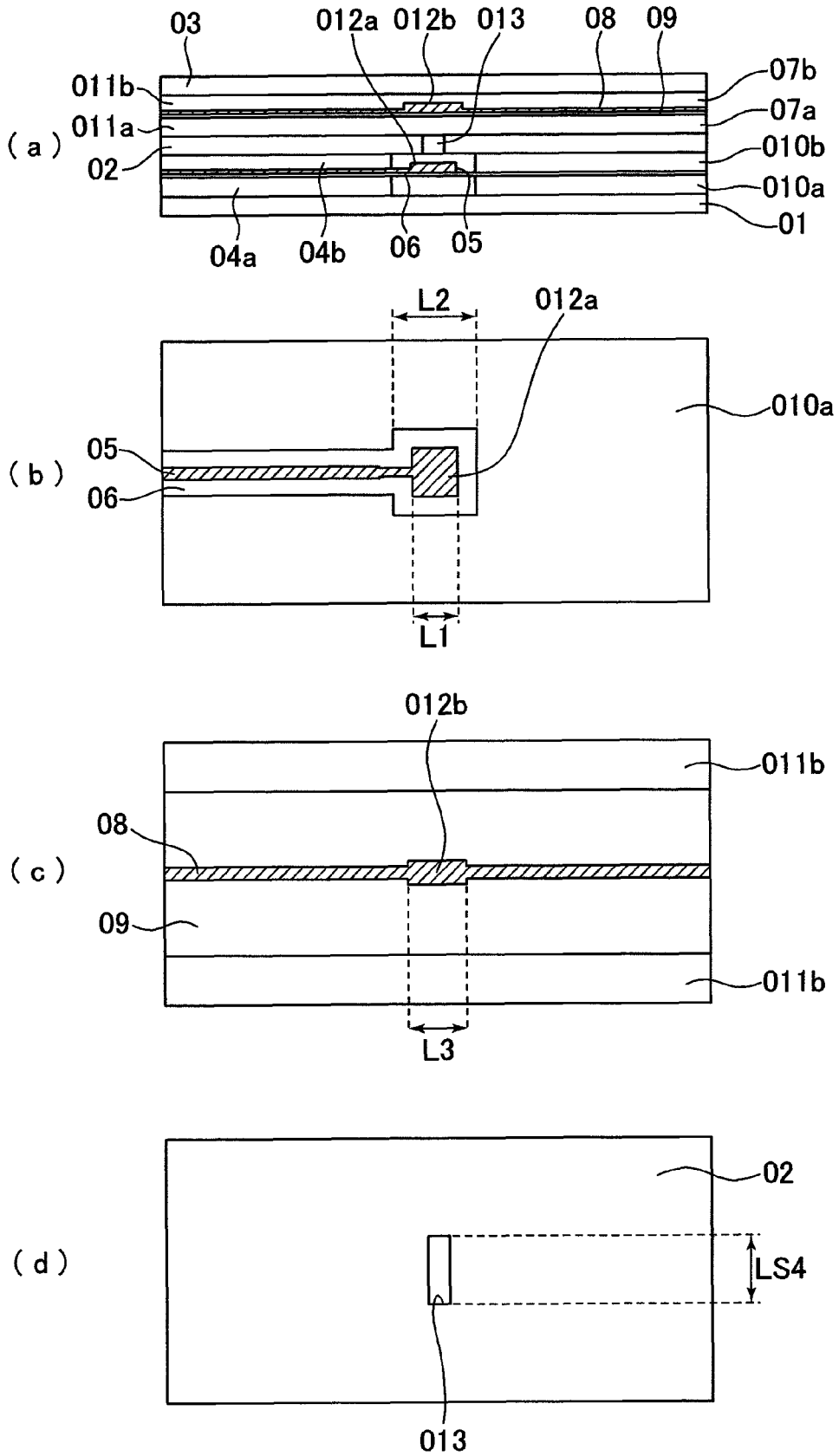

While a shape of each of a first patch pattern (012*a*), a second patch pattern (012*b*) and a first slot (013) is typically a quadrangular shape including a square shape, as shown in FIG. 3, a widthwise dimension may be adjusted according to need, because it has a small impact on a resonance frequency. Alternatively, the shape may be a circular shape, as in a first patch pattern (012*a*) illustrated in FIG. 4(*a*), to have the same function. Further, as for connection between the first patch pattern (012*a*) and a first feeder line (05), they are typically connected by a transformation line (0101) having a line length which is about ¼ of an effective wavelength at an operating frequency, as shown in FIG. 5(*a*), in order to achieve impedance matching between an impedance of an end of the first patch pattern (012*a*) and an impedance of the first feeder line (05). A line width of the transformation line (0101) is designed to achieve impedance matching between an impedance of the feeder line and an impedance of the patch pattern. Instead of the connection illustrated in FIG. 5(*a*), a feeder line may be directly connected to a patch pattern at a matching position within the patch pattern, as shown in FIG. 5(*b*), or may be capacitively coupled with a patch pattern through a small gap (0103), as shown in FIG. 5(*c*). In this case, for example, in a millimeter wave, it is preferable that the gap is approximately equal to or less than ¼ of the effective wavelength λg.

In a triplate line inter-layer connector according to a first embodiment of the present invention, a first triplate line comprises a first shield spacer (010*a*) disposed beneath a first feed substrate (06), and a second shield spacer (010*b*) disposed just above the first feed substrate (06). The first triplate line further comprises a first ground conductor (01) disposed beneath the first shield spacer (010*a*), and a second ground conductor (02) disposed just above the second shield spacer (010*b*). In the first triplate line, a first feeder line (05) and a first patch pattern (012*a*) are formed on the first feed substrate (06) in such a manner that the first feeder line (05) extends from one of opposite edges of the first feed substrate (06), and the first patch pattern (012*a*) is formed at a connection-side terminal end of the first feeder line (05). Each of the first shield spacer (010*a*) and the second shield spacer (010*b*) has a hollow portion which is hollowed out to a size encompassing the first feeder line (05) and the first patch pattern (012*a*), in a position approximately corresponding to the first feeder line (05) and the first patch pattern (012*a*) provided on the first feed substrate (06), when viewed vertically from the side of an after-mentioned third ground conductor (03). A dielectric (04*a*, 04*b*) such as air exists in each of the hollow portions, so that a triplate line consisting of a metal layer-a dielectric layer-a metal layer-a dielectric layer-a metal layer is formed on upper and lower sides of the first feeder line (05) and the first patch pattern (012*a*). As used herein, the term "position approximately corresponding to the first feeder line (05) and the first patch pattern (012*a*)" means a positional relationship that the first feeder line (05) and the first patch pattern (012*a*) fall within an area of each of the hollow portions, when viewed vertically from the side of the third ground conductor (03). This structure makes it possible to shield a periphery of the first feeder line (05) and the first patch pattern (012*a*) by a metal wall, to reduce a leakage loss during propagation of electromagnetic waves.

More specifically, as for the hollow portion hollowed out to a size encompassing the first feeder line (05) and the first patch pattern (012*a*), for example, in a millimeter wave, it is preferable to set the size to allow the hollow portion to be located away from an edge of each of the first feeder line (05) and the first patch pattern (012*a*) by a distance of 0.1 λg to 1 λg. If the distance is less than 0.1 λg, a coupling loss between the patch pattern and a slit becomes larger. If the distance is greater than 1 λg, electromagnetic waves will spread out to cause an increase in transmission loss. The symbol "λg" indicates the effective wavelength.

As for the hollow portion provided in each of the first shield spacer (010*a*) and the second shield spacer (010*b*), in a strict sense, it is desirable that a first dielectric and a second dielectric located at respective positions underneath and just above the first feeder line are different in relative permittivity and thickness, in consideration of a thickness and a relative permittivity of the first feed substrate. However, as long as a material having an extremely small thickness and a low relative permittivity, such as a polyimide film having a thickness of 100 μm or less, is employed as the first feed substrate, it can be used without any problem even if each of the first dielectric (04*a*) and the second dielectric (04*b*) has the approximately same thickness, and it is rather preferable to set thicknesses of them to the approximately same value, in terms of an advantage of being able to simplify a production process. Specifically, it is preferable that the thickness of each of the first dielectric (04*a*) and the second dielectric (04*b*) is 0.3 λg.

For the same reason, it is preferable that each of the first dielectric (04*a*) and the second dielectric (04*b*) consists of the same material.

In a triplate line inter-layer connector according to a second embodiment of the present invention, while the first patch pattern (012*a*) is not necessarily located in an approximately central region of the first feed substrate, it is preferable that the first patch pattern (012*a*) is located in a central region of an antenna finally assembled together with other components. The first patch pattern located in the approximately central region provides an advantage of being able to obtain excellent beam characteristics, for example, keep a direction of a main beam constant in a desired frequency range.

In the triplate line inter-layer connector according to the first embodiment, a second triplate line is formed such that a second feed substrate (09) provided with a second feeder line (08) and sandwiched between a third dielectric (04*c*) and a fourth dielectric (04*d*) is located approximately intermediate between the second ground conductor (02) and a third ground conductor (03). In the second triplate line, the second feeder line (08) extends from a first one of opposite edges to the other, second, edge of the second feed substrate (09), and a second patch pattern (012*b*) is formed on the second feeder line (08). The second feeder line (08) formed to extend from the first edge to the second edge of the second feed substrate (09) allows exchange of electromagnetic waves via inter-layer connection with a metal layer provided outside relative to the third ground conductor (03) to be performed at any position on the second feeder line (08).

Further, in the triplate line inter-layer connector according to the first embodiment, in a strict sense, it is desirable that a third dielectric and a fourth dielectric located at respective positions underneath and just above the second feeder line are different in relative permittivity and thickness, in consideration of a thickness and a relative permittivity of the second feed substrate. However, as long as a material having an extremely small thickness and a low relative permittivity, such as a polyimide film having a thickness of 100 μm or less, is employed as the second feed substrate, it can be used without any problem even if each of the third dielectric (04*c*) and the fourth dielectric (04*d*) has the approximately same thickness, and it is rather preferable to set thicknesses of them to the approximately same value, in terms of an advantage of being able to simplify a production process. Specifically, for example, in a millimeter wave, it is preferable that the thickness of each of the third dielectric (04*c*) and the fourth dielectric (04*d*) is in the range of 100 to 700 μm.

For the same reason, it is preferable that each of the third dielectric (04*c*) and the fourth dielectric (04*d*) consists of the same material.

In the triplate line inter-layer connector according to the first embodiment, the first slit (013) is located at any position between the first patch pattern (012*a*) and the second patch pattern (012*b*). Preferably, a distance between the first slit (013) and the first patch pattern (012*a*) or the second patch pattern (012*b*) is set to be 0.5 λg or less. In this case, electromagnetic waves can be transmitted with high efficiency.

In the triplate line inter-layer connector according to the first embodiment, the first patch pattern (012*a*), the first slit (013) and the second patch pattern (012*b*) are located to approximately overlap each other, when viewed vertically from the side of the third ground conductor (03). As used herein, the term "located to approximately overlap each other" means that respective center points of the first patch pattern (012*a*), the first slit (013) and the second patch pattern (012*b*) fall within a circle having a radius of 0.1 λg.

In a triplate line inter-layer connector according to a second embodiment of the present invention, a first triplate line comprises a first shield spacer (010*a*) disposed beneath a first feed substrate (06), a second shield spacer (010*b*) disposed just above the first feed substrate (06), a first ground conductor (01) disposed beneath the first shield spacer (010*a*), and a second ground conductor (02) disposed just above the second shield spacer (010*b*). In the first triplate line, a first feeder line (05) and a first patch pattern (012*a*) are formed on the first feed substrate (06) in such a manner that the first feeder line (05) extends from one of opposite edges of the first feed substrate (06), and the first patch pattern (012*a*) is formed at a connection-side terminal end of the first feeder line (05). Each of the first shield spacer (010*a*) and the second shield spacer (010*b*) has a hollow portion which is hollowed out to a size encompassing the first feeder line (05) and the first patch pattern (012*a*), in a position approximately corresponding to the first feeder line (05) and the first patch pattern (012*a*) provided on the first feed substrate (06), when viewed vertically from the side of an after-mentioned third ground conductor (03). A dielectric (04*a*, 04*b*) such as air exists in each of the hollow portions, so that a triplate line consisting of a metal layer-a dielectric layer-a metal layer-a dielectric layer-a metal layer is formed on upper and lower sides of the first feeder line (05) and the first patch pattern (012*a*). As used herein, the term "position approximately corresponding to the first feeder line (05) and the first patch pattern (012*a*)" means a positional relationship that the first feeder line (05) and the first patch pattern (012*a*) fall within an area of each of the hollow portions, when viewed vertically from the side of the third ground conductor (03). This structure makes it possible to shield a periphery of the first feeder line (05) and the first patch pattern (012*a*) by a metal wall, to reduce a leakage loss during propagation of electromagnetic waves.

More specifically, it is preferable that an inner periphery of the hollow portion hollowed out to a size encompassing the first feeder line (05) and the first patch pattern (012*a*) is located away from an outer periphery of each of the first feeder line (05) and the first patch pattern (012*a*) by a distance of 0.1 λg or more. If the distance is less than 0.1 λg, an electromagnetic coupling loss between the patch pattern and a slot becomes larger.

As for the hollow portion provided in each of the first shield spacer (010*a*) and the second shield spacer (010*b*), in a strict sense, it is desirable that a first dielectric and a second dielectric located at respective positions underneath and just above the first feeder line are different in relative permittivity and thickness, in consideration of a thickness and a relative permittivity of the first feed substrate. However, as long as a material having an extremely small thickness and a low relative permittivity, such as a polyimide film having a thickness of 100 μM or less, is employed as the first feed substrate, it can be used without any problem even if each of the first dielectric (04*a*) and the second dielectric (04*b*) has the approximately same thickness, and it is rather preferable to set thicknesses of them to the approximately same value, in terms of an advantage of being able to simplify a production process. Specifically, it is preferable that the thickness of each of the first dielectric (04*a*) and the second dielectric (04*b*) is 0.3 λg.

For the same reason, it is preferable that each of the first dielectric (04*a*) and the second dielectric (04*b*) consists of the same material.

In the triplate line inter-layer connector according to the second embodiment, while the first patch pattern (012*a*) is not necessarily located in an approximately central region of the first feed substrate, it is preferable that the first patch pattern (012*a*) is located in a central region of an antenna finally assembled together with other components. The first patch pattern located in the approximately central region provides an advantage of being able to obtain excellent beam characteristics, for example, keep a direction of a main beam constant in a desired frequency range.

In the triplate line inter-layer connector according to the second embodiment, a second triplate line is formed such that a third shield spacer (011*a*) and a fourth shield spacer (011*b*) each adapted to define a dielectric which has a size encompassing a second feeder line (08) and a second patch pattern (012*b*) and extends between opposite ends in a line direction of the second feeder line (08) are disposed at respective positions beneath and just above a second feed substrate (09), and the second ground conductor (02) and a third ground conductor (03) are disposed at respective positions outside the third shield spacer (011*a*) and the fourth shield spacer (011*b*). The triplate line inter-layer connector having this structure can also obtain the same level of loss reduction effect as that in the triplate line structure in the first embodiment.

In the second triplate line, the second feeder line (08) extends from a first one of opposite edges to the other, second, edge of the second feed substrate (09), and the second patch pattern (012*b*) is formed on the second feeder line (08). The second feeder line (08) formed to extend from the first edge to the second edge of the second feed substrate (09) allows exchange of electromagnetic waves via inter-layer connection with a metal layer provided outside relative to the third ground conductor (03) to be performed at any position on the second feeder line (08). Further, while the second patch pattern (012*b*) is not necessarily located in a central region of the second feeder line (08), it is preferable that the second patch pattern (012*b*) is located in a central region of an antenna finally assembled together with other components. The second patch pattern located in the approximately central region provides an advantage of being able to obtain excellent beam characteristics, for example, keep a direction of a main beam constant in a desired frequency range.

Further, in the triplate line inter-layer connector according to the second embodiment, in a strict sense, it is desirable that a third dielectric and a fourth dielectric located at respective positions underneath and just above the second feeder line are different in relative permittivity and thickness, in consideration of a thickness and a relative permittivity of the second feed substrate. However, as long as a material having an extremely small thickness and a low relative permittivity, such as a polyimide film having a thickness of 100 μm or less, is employed as the second feed substrate, it can be used without any problem even if each of the fifth dielectric (07*a*) and the sixth dielectric (07*b*) has the approximately same thickness, and it is rather preferable to set thicknesses of them to the approximately same value, in terms of an advantage of being able to simplify a production process.

For the same reason, it is preferable that each of the third dielectric (04*c*) and the fourth dielectric (04*d*) consists of the same material.

In the triplate line inter-layer connector according to the second embodiment, it is preferable that the first slit (013) is located approximately intermediate between the first patch pattern (012*a*) and the second patch pattern (012*b*). The first slit located at the approximately intermediate position allows electromagnetic waves to be transmitted with high efficiency.

In the triplate line inter-layer connector according to the second embodiment, the first patch pattern (012*a*), the first slit (013) and the second patch pattern (012*b*) are located to approximately overlap each other, when viewed vertically from the side of the third ground conductor (03). As used herein, the term "located to approximately overlap each other" means that respective center points of the first patch pattern (012*a*), the first slit (013) and the second patch pattern (012*b*) fall within a circle having a radius of 0.1 λg.

In the triplate line inter-layer connector according to the present invention, the first patch pattern (012*a*) has, in a line direction of the associated feeder line, a length L1 which is about ¼ to ½ times greater than the effective wavelength λg at the operating frequency, and a part of the hollow portion hollowed out to a size encompassing the first patch pattern (012*a*), in each of the first shield spacer (010*a*) and the second shield spacer (010*b*), has, in a line direction of the associated feeder line, a length L2 which is about 0.6 times greater than the effective wavelength λg at the operating frequency. Further, the second patch pattern (012*b*) has, in a line direction of the associated feeder line, a length L3 which is 0.35 to 0.5 times greater than the effective wavelength λg at the operating frequency, and the first slit (013) has, in a direction perpendicular to the second feeder line, a length LS4 which is 0.4 to 0.6 times greater than the effective wavelength λg at the operating frequency. The triplate line inter-layer connector having this configuration can obtain an excellent reflection characteristic (VSWR: Voltage Standing Wave Ratio) and a low-leakage loss characteristic, in an effective wavelength at an operating frequency range of 76.5 GHz±1 GHz. It is also able to apply a triplate line inter-layer connector of the present invention to a planar array antenna.

EXAMPLE 1

Firstly, based on FIGS. 2, 3 and 5, a first example of the triplate line inter-layer connector according to the present invention will be described. An aluminum plate having a thickness of 1 mm was used for each of the first ground conductor (01) and the third ground conductor (03), and an air layer having a thickness of 0.3 mm (serving as a hollow portion having a height dimension of 0.3 mm) was used for each of the first dielectric (04*a*), the second dielectric (04*b*), the fifth dielectric (07*a*) and the sixth dielectric (07*b*). Further, the first feed substrate (06) was prepared by laminating a copper foil on a polyimide film to obtain a flexible substrate, and removing an unnecessary part of the copper foil from the flexible substrate by etching to form the first feeder line (05) and the first patch pattern (012*a*) thereon. As with the first feed substrate, the second feed substrate (09) was prepared by laminating a copper foil on a polyimide film to obtain a flexible substrate, and removing an unnecessary part of the copper foil from the flexible substrate by etching to form the second feeder line (08) and the second patch pattern (012*b*) thereon. The second ground conductor (02) was prepared by subjecting an aluminum plate having a thickness of 0.7 mm to a mechanical punch press process while forming the first slit (013) therein, and each of the first shield spacer (010*a*), the second shield spacer (010*b*), the third shield spacer (011*a*) and the fourth shield spacer (011*b*) was prepared by subjecting an aluminum plate having a thickness of 0.3 mm to a mechanical punch press process.

In the first example, each of the first shield spacer (010*a*) and the second shield spacer (010*b*) is disposed to form a metal wall surrounding three sides of the first patch pattern (012*a*) except one side connected with the first feeder line (05), with a distance therebetween, and each of the third shield spacer (011*a*) and the fourth shield spacer (011*b*) is disposed to form a metal wall along the second feeder line (08) connected to opposite edges of the second patch pattern (012*b*), with a distance therebetween. In this state, each of the fifth dielectric (07*a*) and the sixth dielectric (07*b*) is defined by a respective one of the third shield spacer (011*a*) and the fourth shield spacer (011*b*), to form a dielectric extending up to the opposite edges of the second feed substrate (09) in the line direction of the second feeder line (08), so that inter-layer connection can be achieved at any position on the second feeder line (08) connected to the respective opposite edges of the second patch pattern (012*b*).

Based on the above configuration, it becomes possible to fully transmit electromagnetic waves from the first patch pattern (012*a*) to the second patch pattern (012*b*) without the occurrence of a parallel plate component to achieve a low-loss characteristic. In addition, based on the second feeder line (08) formed to extend from the opposite edges of the second patch pattern (012*b*) to the opposite edges of the second feed substrate (09), it becomes possible to achieve inter-layer connection at any position on the second feeder line (08).

The first patch pattern (012*a*) was formed in a square shape, wherein L1 illustrated in FIG. 3(*b*) was set to 1.5 mm which is about 0.38 times greater than an effective wavelength (λg=3.64 mm) at an operating frequency of 76.5 GHz. In this connection, it has been verified that an excellent result is obtained when L1 is in the range of about ¼ to ½ times greater than a free-space wavelength λg at an operating frequency, as set forth in the appended claims. If L1 is set in the above range, the emission of electromagnetic wave from the first patch pattern (012*a*) will be advantageously facilitated.

As for the hollow portion in each of the first shield spacer (010*a*) and the second shield spacer (010*b*), L2, which is a length of the inner periphery thereof surrounding the patch pattern in the line direction, was set to be about 6 times greater than the effective wavelength λg at the operating frequency.

As for the second patch pattern (012*b*), L3 illustrated in FIG. 3(*c*) was set to 1.975 mm which is 0.5 times greater than the effective wavelength (λg=3.64 mm) at the operating frequency 76.5 GHz. In this connection, it has been verified that an excellent result is obtained when L3 is in the range of 0.35 to 0.5 times greater than a free-space wavelength λg at an operating frequency, as set forth in the appended claims.

As for the first slit (013), LS4 illustrated in FIG. 3(*d*) was set to 1.8 mm which is about 0.5 times greater than the effective wavelength (λg=3.64 mm) at the operating frequency 76.5 GHz. In this connection, it has been verified that an excellent result is obtained when LS4 is in the range of 0.4 to 0.6 times greater than a free-space wavelength λg at an operating frequency, as set forth in the appended claims.

The lengths Ls of the first shield spacer (010*a*) and the second shield spacer (010*b*) were set to the same value.

Further, a transformation line (0101) having a length about 0.25 times greater than the effective wavelength (λg=3.64 mm) at the operating frequency 76.5 GHz was formed to connect between the first feeder line (05) and the first patch pattern (012*a*). In this state, the second patch pattern (012*b*) and the second feeder line (08) located above the slit (013) were arranged to achieve impedance matching between an impedance of the second patch pattern (012*b*) and an impedance of the second feeder line (08). This impedance matching can be achieved by appropriately determining a size of the second patch pattern (012*b*), to obtain a desired VSWR value (1.3 or less).

Figure 6:
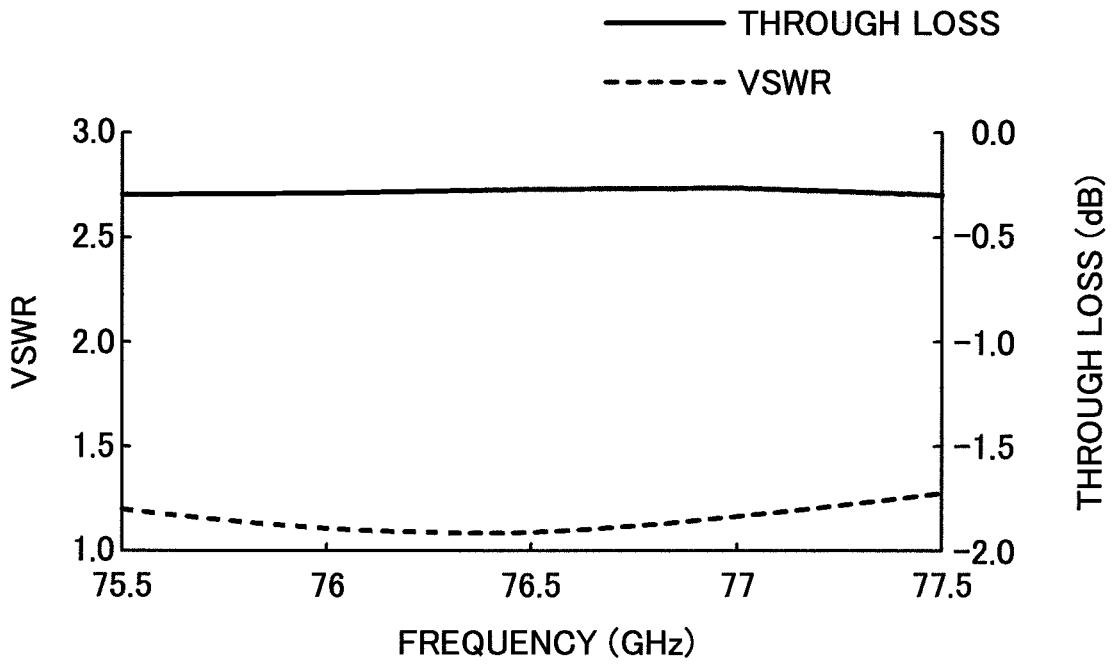
FIG. 6 is a graph showing a reflection loss/through loss vs frequency characteristic in a triplate line inter-layer connector according to one embodiment of the present invention.
Figure 7:
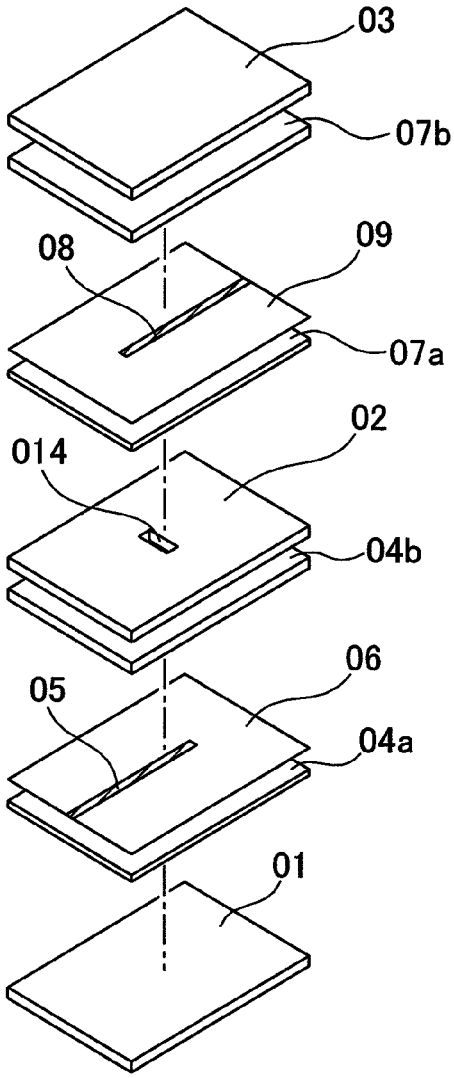
FIG. 7 is an exploded perspective view showing a conventional triplate line inter-layer connector.
Figure 8:
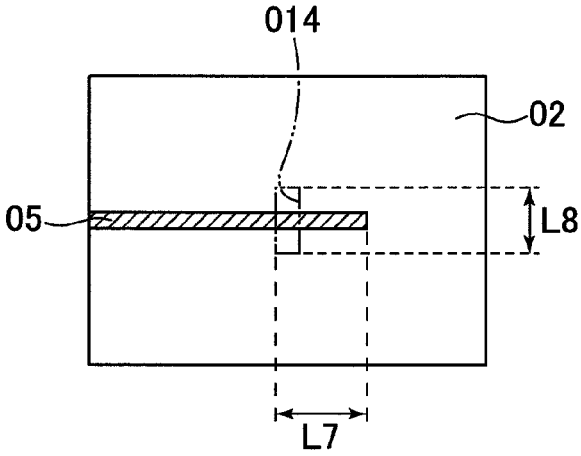
FIG. 8 is a top plan view for explaining a problem in the conventional triplate line inter-layer connector.

The above members, i.e., the first ground conductor (01), the first shield spacer (010*a*), the first feed substrate (06), the second shield spacer (010*b*), the second ground conductor (02), the third shield spacer (011*a*), the second feed substrate (09), the fourth shield spacer (011*b*) and the third ground conductor (03), were layered upwardly in this order, as shown in FIG. 3(*a*), to form a triplate line inter-layer connector. Then, a measurement unit was connected to one of the first feeder line (05) and the second feeder line (08), and electromagnetic waves were fed thereto to measure a reflection characteristic (VSWR) at an end of the first feeder line (05) and a through loss during transmission of electromagnetic waves from the first feeder line (05) to one end of the second feeder line (08). As a result, excellent characteristics, specifically, a reflection characteristic (VSWR) of 1.5 or less and a through loss of 0.5 dB or less, were obtained in the range of 76.5±1 GHz, as shown in FIG. 6.

Figure 1:
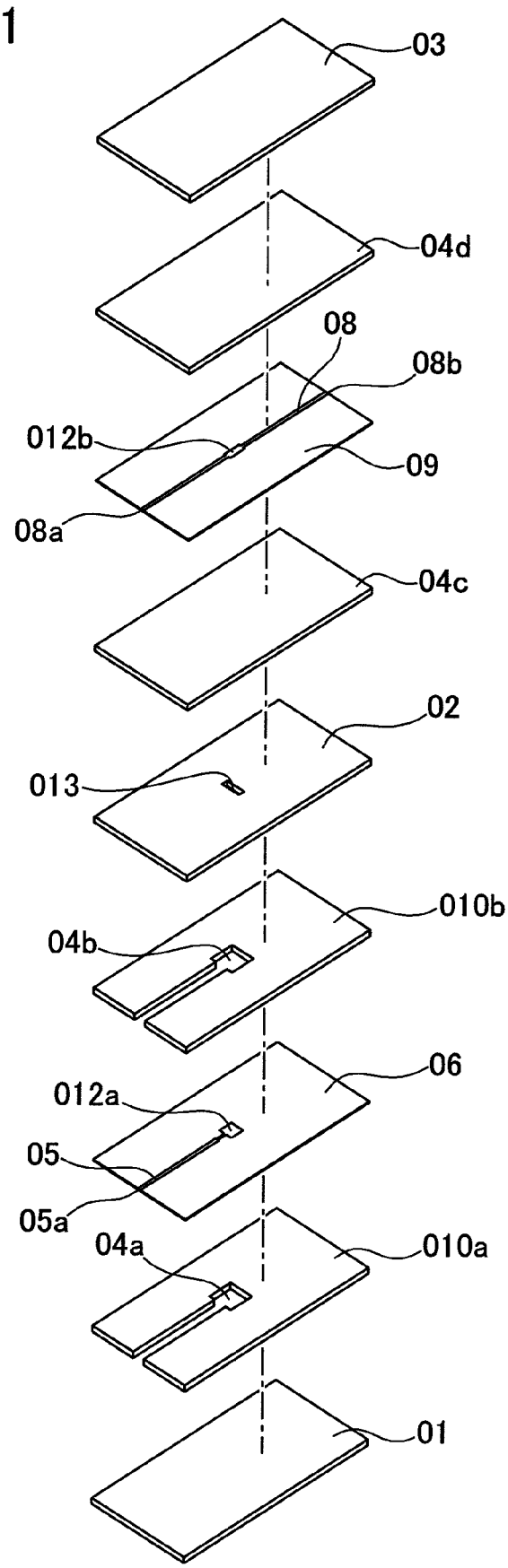
FIG. 1 is an exploded perspective view showing a triplate line inter-layer connector according to one embodiment of the present invention.
Figure 2:
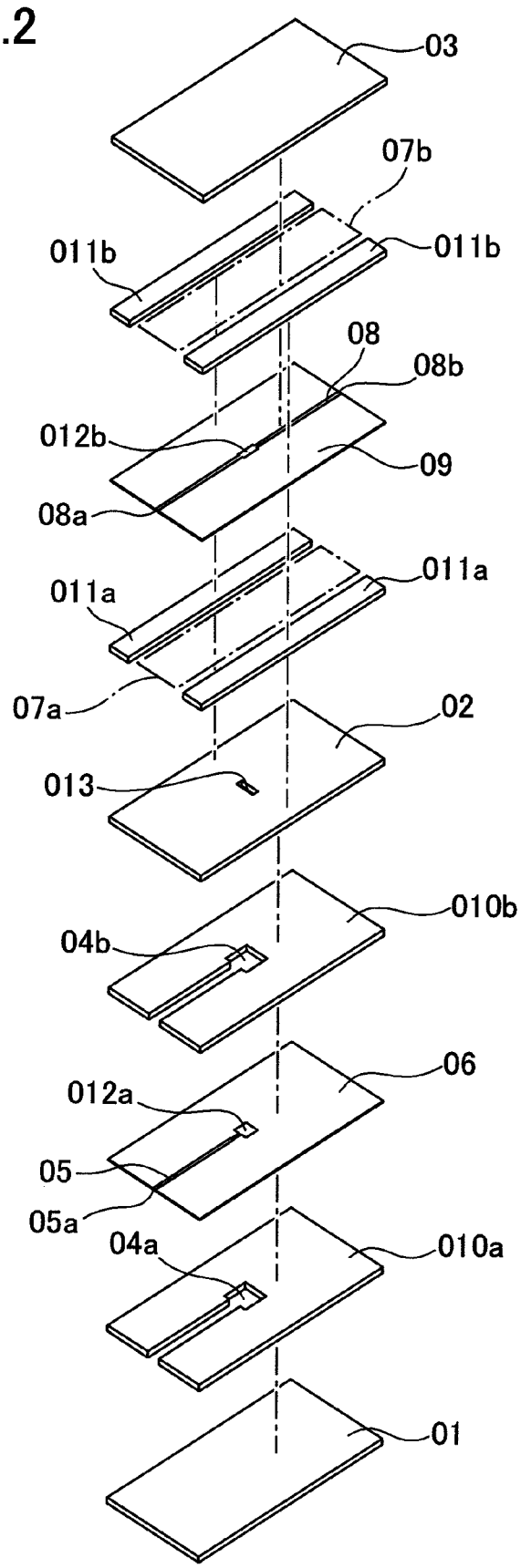
FIG. 2 is an exploded perspective view showing a triplate line inter-layer connector according to another embodiment of the present invention.

In Example 1, the third shield spacer (011*a*) having the fifth dielectric (07*a*) and the fourth shield spacer (011*b*) having the sixth dielectric (07*b*) were used, as shown in FIG. 2. Alternatively, the third dielectric (04*c*) and the fourth dielectric (04*d*) may be used by modifying the third shield spacer (011*a*) and the fourth shield spacer (011*b*), as shown in FIG. 1. As shown in FIG. 1, each of the third dielectric (04*c*) and the fourth dielectric (04*d*) forms a single plate-like dielectric layer having approximately the same shape as that of each of the second ground conductor (02) and the third ground conductor (03).

In a triplate line inter-layer connector based on the configuration illustrated in FIG. 1, electromagnetic waves can also be fully transmitted from the first patch pattern (012*a*) to the second patch pattern (012*b*) to achieve a low-loss characteristic without the occurrence of a parallel plate component. In addition, based on the second feeder line (08) formed to extend from the opposite edges of the second patch pattern (012*b*) to the opposite edges of the second feed substrate (09), it becomes possible to achieve inter-layer connection at any position on the second feeder line (08).

EXAMPLE 2

Secondly, based on FIGS. 4 and 5, a second example of the triplate line inter-layer connector according to the present invention will be described. An aluminum plate having a thickness of 1 mm was used for each of the first ground conductor (01) and the third ground conductor (03), and an air layer having a thickness of 0.3 mm (serving as a hollow portion having a height dimension of 0.3 mm) was used for each of the first dielectric (04*a*), the second dielectric (04*b*), the fifth dielectric (07*a*) and the sixth dielectric (07*b*). Further, the first feed substrate (06) was prepared by laminating a copper foil on a polyimide film to obtain a flexible substrate, and removing an unnecessary part of the copper foil from the flexible substrate by etching to form the first feeder line (05) and the first patch pattern (012*a*) thereon. As with the first feed substrate, the second feed substrate (09) was prepared by laminating a copper foil on a polyimide film to obtain a flexible substrate, and removing an unnecessary part of the copper foil from the flexible substrate by etching to form the second feeder line (08) and the second patch pattern (012*b*) thereon. The second ground conductor (02) was prepared by subjecting an aluminum plate having a thickness of 0.7 mm to a mechanical punch press process while forming the first slit (013) therein, and each of the first shield spacer (010*a*), the second shield spacer (010*b*), the third shield spacer (011*a*) and the fourth shield spacer (011*b*) was prepared by subjecting an aluminum plate having a thickness of 0.3 mm to a mechanical punch press process.

In the second example, each of the first shield spacer (010*a*) and the second shield spacer (010*b*) is disposed to form a metal wall surrounding three sides of the first patch pattern (012*a*) except one side connected with the first feeder line (05), with a distance therebetween, and each of the third shield spacer (011*a*) and the fourth shield spacer (011*b*) is disposed to form a metal wall along the second feeder line (08) connected to opposite edges of the second patch pattern (012*b*), with a distance therebetween. In this state, each of the fifth dielectric (07*a*) and the sixth dielectric (07*b*) is defined by a respective one of the third shield spacer (011*a*) and the fourth shield spacer (011*b*), to form a dielectric extending up to the opposite edges of the second feed substrate (09) in the line direction of the second feeder line (08), so that inter-layer connection can be achieved at any position on the second feeder line (08) connected to the respective opposite edges of the second patch pattern (012*b*).

Based on the above configuration, it becomes possible to fully transmit electromagnetic waves from the first patch pattern (012*a*) to the second patch pattern (012*b*) without the occurrence of a parallel plate component to achieve a low-loss characteristic. In addition, based on the second feeder line (08) formed to extend from the opposite edges of the second patch pattern (012*b*) to the opposite edges of the second feed substrate (09), it becomes possible to achieve inter-layer connection at any position on the second feeder line (08).

Figure 4:
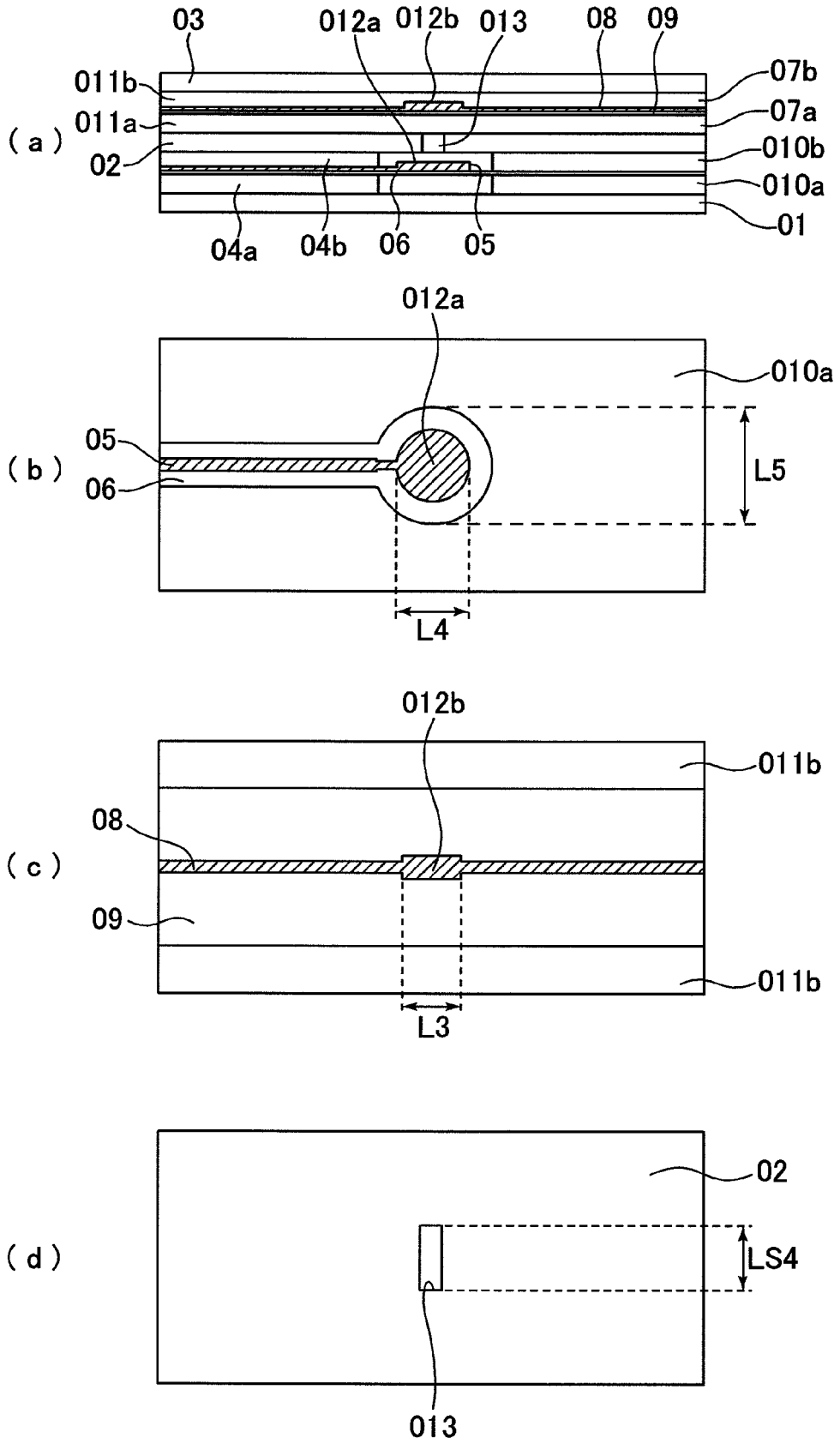
FIG. 4 illustrates a triplate line inter-layer connector according to one embodiment of the present invention, wherein FIG. 3(*a*) is a sectional view of the triplate line inter-layer connector.
Figure 5:
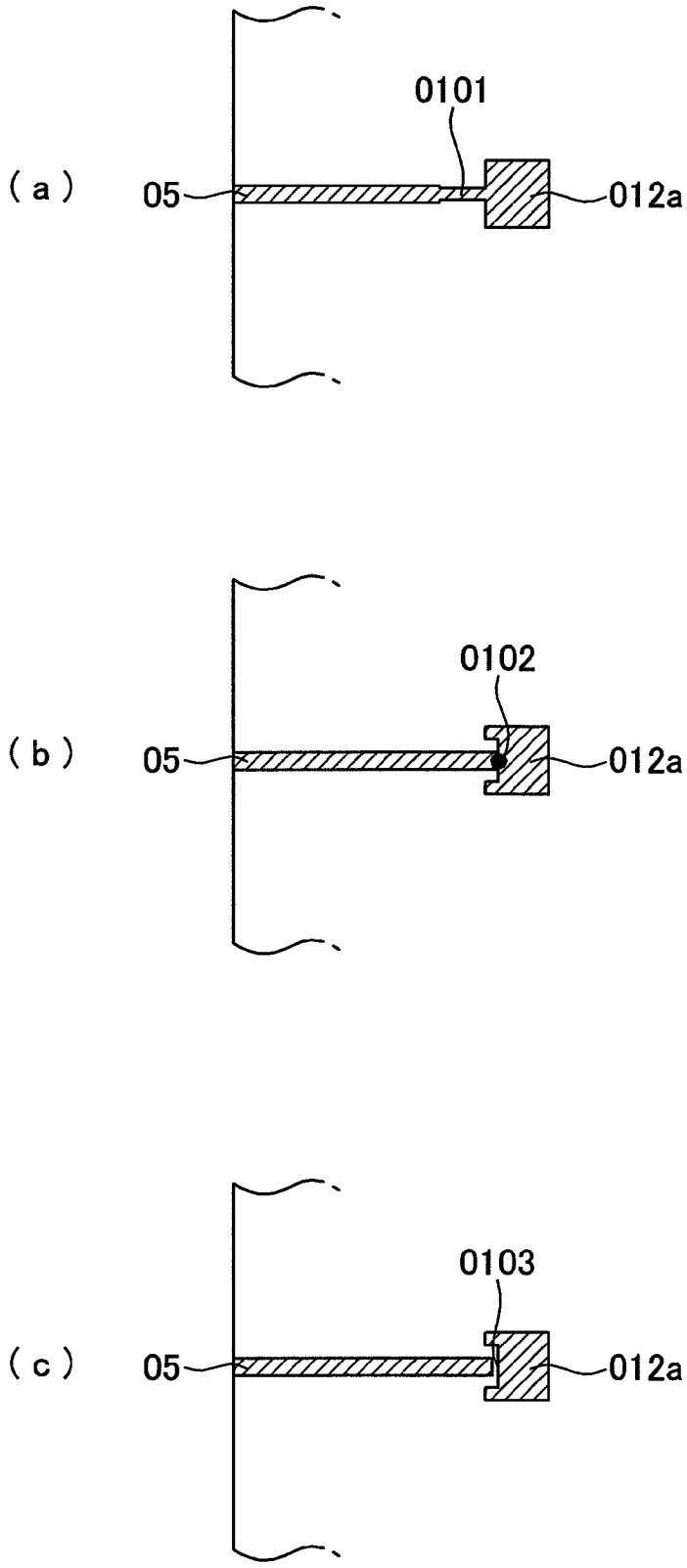
FIGS. 5(*a*), 5(*b*) and 5(*c*) are top plan views showing examples of connection between a patch pattern and a first feeder line, usable in a triplate line inter-layer connector according to the present invention.

The first patch pattern (012*a*) was formed in a circular shape, wherein L4 illustrated in FIG. 4(*b*) was set to 1.5 mm which is about 0.38 times greater than an effective wavelength (λg=3.64 mm) at an operating frequency of 76.5 GHz. In this connection, it has been verified that an excellent result is obtained when L4 is in the range of about ¼ to ½ times greater than a free-space wavelength λg at an operating frequency, as set forth in the appended claims.

As for the hollow portion in each of the first shield spacer (010*a*) and the second shield spacer (010*b*), the inner periphery thereof surrounding the patch pattern was formed in a circular shape, and a diameter L5 thereof was set to be about 6 times greater than the effective wavelength λg at the operating frequency.

As for the second patch pattern (012*b*), L3 illustrated in FIG. 4(*c*) was set to 1.975 mm which is 0.5 times greater than the effective wavelength (λg=3.64 mm) at the operating frequency 76.5 GHz.

A length LS4 of the first slit (013) was set to 1.8 mm which is about 0.5 times greater than the effective wavelength (λg=3.64 mm) at the operating frequency 76.5 GHz.

The lengths Ls of the first shield spacer (010*a*) and the second shield spacer (010*b*) were set to the same value.

Further, a transformation line (0101) having a length about 0.25 times greater than the effective wavelength (λg=3.64 mm) at the operating frequency 76.5 GHz was formed to connect between the first feeder line (05) and the first patch pattern (012*a*). In this state, the second patch pattern (012*b*) and the second feeder line (08) located above the slit (013) were arranged to achieve impedance matching between an impedance of the second patch pattern (012*b*) and an impedance of the second feeder line (08). This impedance matching can be achieved by appropriately determining a size of the second patch pattern (012*b*), to obtain a desired VSWR value (1.3 or less).

The above members, i.e., the first ground conductor (01), the first shield spacer (010*a*), the first feed substrate (06), the second shield spacer (010*b*), the second ground conductor (02), the third shield spacer (011*a*), the second feed substrate (09), the fourth shield spacer (011*b*) and the third ground conductor (03), were layered in this order from bottom to top, as shown in FIG. 4(*a*), to form a triplate line inter-layer connector. Then, a measurement unit was connected to one of the first feeder line (05) and the second feeder line (08), and electromagnetic waves were fed thereto to measure a reflection characteristic (VSWR) at an end of the first feeder line (05) and a through loss during transmission of electromagnetic waves from the first feeder line (05) to one end of the second feeder line (08). As a result, excellent characteristics equivalent to those in Example 1 were obtained.

[Planar Array Antenna According to the Present Invention]

A planar array antenna according to a preferred embodiment of the present invention will be specifically described, with reference to the drawings if necessary. The figures are used for the purpose of illustrating contents of the present invention, but they do not accurately reflect a dimensional ratio between elements or components.

(Basic Configuration)

Figure 9:
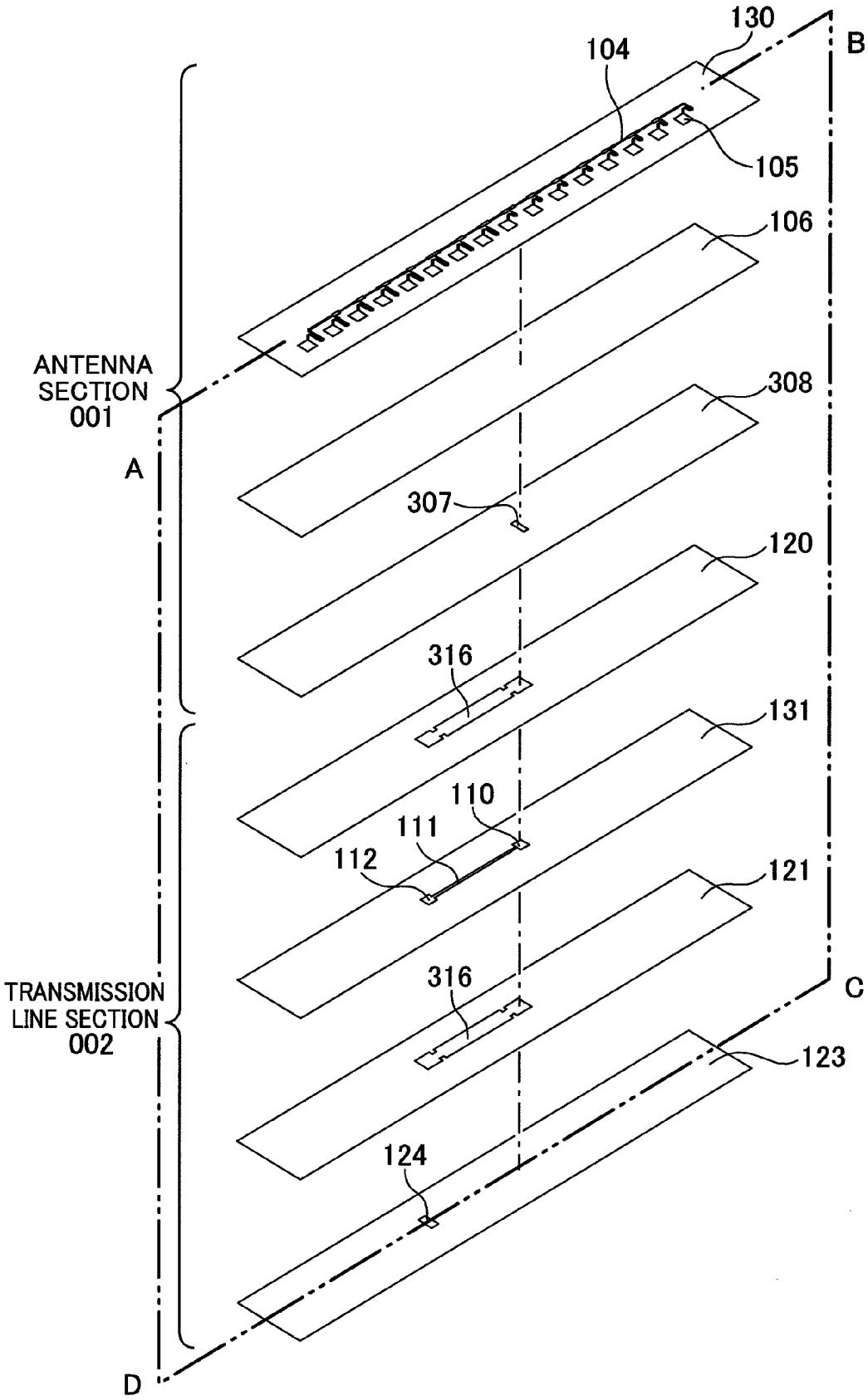
FIG. 9 illustrates, in a perspective view, a configuration of a planar array antenna according to one embodiment of the present invention.

FIG. 9 illustrates a configuration of a planar array antenna according to one embodiment of the present invention A planar array antenna of the present invention has a multilayer structure comprising an antenna section 001 including a feeder line 104 and a transmission line section 002 including a transmission line 111.

The transmission line 111 adapted to link the feeder line 104 with a waveguide opening 124 for connection to an electromagnetic-wave receiving/transmitting section is provided on a layer other than an antenna substrate 130, so that the waveguide opening can be arranged at any position away from a position just below the feeder line.

In the planar array antenna of the present invention, the antenna section 001 includes the antenna substrate 130 and a first ground conductor 308 having a slit 307. Preferably, a first dielectric 106 is provided between the antenna substrate 130 and the first ground conductor 308 to increase flexibility in material selections and in dimensional designs. A thickness of the first dielectric 106 and a thickness of a dielectric of the antenna substrate 130 are determined in consideration of a relative permittivity of the dielectric, a line width and thickness of the feeder line 104 and an impedance of the antenna section 001. In cases where the first dielectric 106 is used, it is preferable to set the thickness of the first dielectric 106 in such a manner that a total thickness of the dielectric of the antenna substrate 130 and the first dielectric 106 falls within the range of 0.01 to 0.5 mm. In cases where the first dielectric 106 is not used, it is preferable that the thickness of the dielectric of the antenna substrate 130 is in the range of 0.01 to 0.5 mm.

As a dielectric for use in the planar array of the present invention, it is preferable to use a foamed material having a small relative permittivity with respect to air, or air (i.e., a hollow portion). The foamed material to be used may include a polyolefin-based foamed material such as polyethylene or polypropylene, a polystyrene-based foamed material, a polyurethane-based foamed material, a polysilicone-based foamed material, and a rubber-based foamed material, wherein a polyolefin-based foamed material is particularly preferable because it has a low relative permittivity with respect to air.

In the planar array antenna of the present invention, the antenna substrate 130 has an antenna region which comprises a radiation element array consisting of a plurality of radiation elements 105 arranged approximately in one line, and the feeder line 104 connected to the respective radiation elements of the radiation element array. In other words, a plurality of radiation elements 105 are arranged approximately in one line to form a radiation element array, and the feeder line is connected to the respective radiation elements of the radiation element array to form an antenna region. As used herein, the term "approximately in one line" means that the radiation elements 105 may be misaligned with each other to an extent that antenna characteristics are not spoiled. Thus, the radiation elements 105 may be arranged in a zigzag pattern to an extent that antenna characteristics are not spoiled.

The feeder line, the slit, and the patch pattern, are provided at respective positions approximately corresponding to each other in a thicknesswise direction of the planar array antenna.

A positional relationship between the feeder line and the slit will be described based on FIG. 10.

Figure 10:
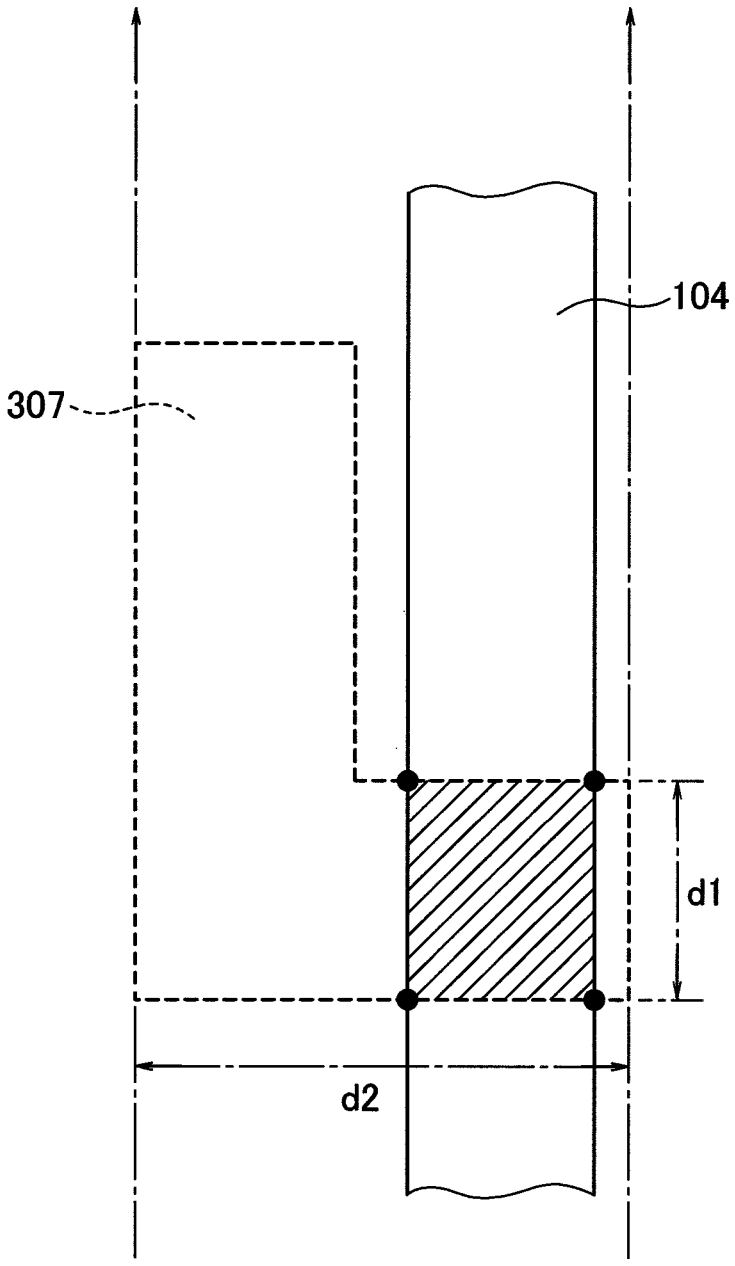
FIG. 10 illustrates, in a top plan view, a positional relationship between a feeder line and a slit provided in a first ground conductor, in a planar array antenna according to one embodiment of the present invention.

As shown in FIG. 10, the feeder line 104 and the slit 307 partially overlay each other (shaded region in FIG. 10), when viewed in the thicknesswise direction of the planar array antenna. A maximum distance of the overlap region in a longitudinal direction of the feeder line is defined as d1. Further, a distance between two straight lines extending parallel to the longitudinal direction of the feeder line to sandwich the slit therebetween is defined as d2. In other words, d1 represents a length of the slit 307 in the longitudinal direction of the feeder line 104, in the overlap region. Under this definition, respective shapes and positions of the slit and the feeder line are adjusted to satisfy the following relationship: d1<d2. In FIG. 10, the positional relationship has been described based on an L-shaped slit. Differently, in a rectangular-shaped slit, d1 represents a length in a short-axis direction, and d2 represents a length in a long-axis direction. In view of a reduction in area of the antenna substrate, it is preferable to use a high-frequency signal, because it can be transmitted from/to the feeder line through the slit 307.

Figure 11:
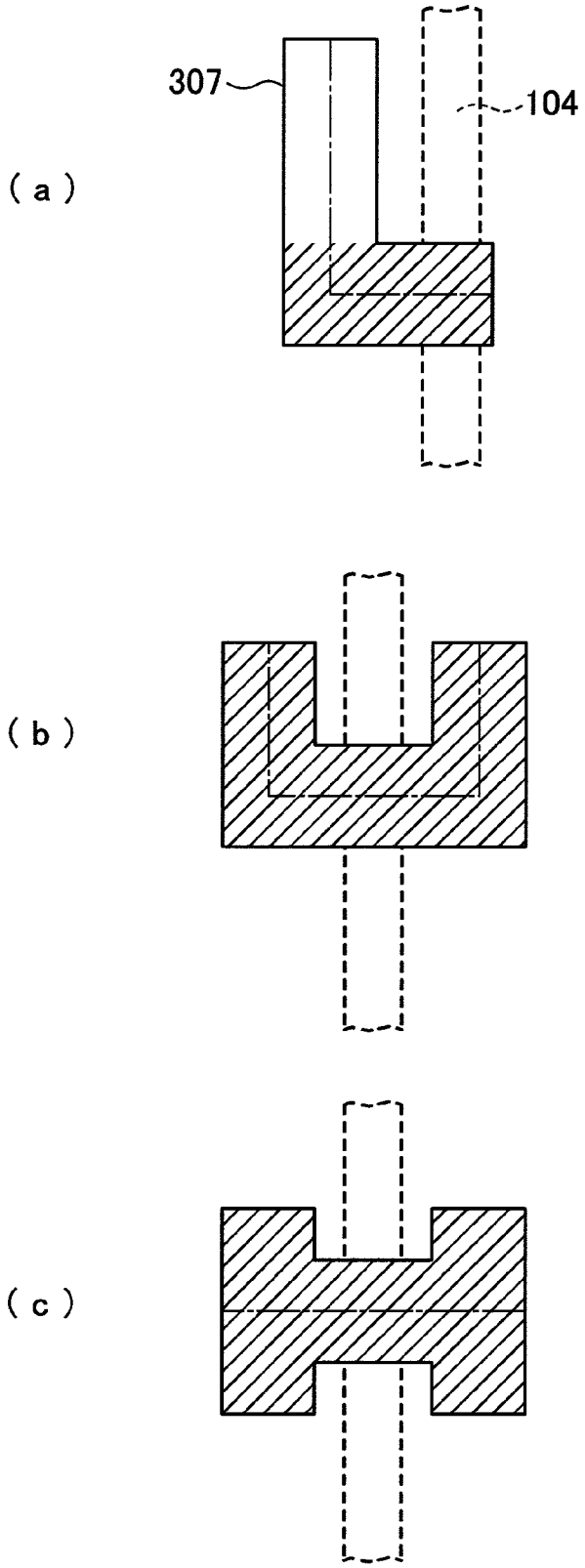
FIG. 11 illustrates, in top plan views, preferred examples of another shape of the slit provided in the first ground conductor in the planar array antenna illustrated in FIG. 10.

In the planar array antenna of the present invention, it is preferable that the slit has a quadrangular shape (including a rectangular shape), a polygonal shape, or an elliptical or oval shape. In the rectangular-shaped slit, it is preferable that the slit is provided at a position corresponding to the feeder line and the first patch pattern in the thicknesswise direction of the planar array antenna, and a long axis thereof extends in a direction perpendicular to a longitudinal direction of the feeder line. It has been verified that excellent effects equivalent to those of the rectangular-shaped slit can also be obtained by use of a polygonal-shaped slit as shown in FIGS. 11(*a*) to 11(*c*), i.e., an L-shaped slit (FIG. 11(*a*)), an angular C-shaped slit (FIG. 11(*b*)), or an H-shaped slit (FIG. 11(*c*)). This is because the slit is simply required to resonate at an operating efficiency to emit a high-frequency signal. Therefore, the shape of the slit is not limited to a linear shape, but any other suitable shape having a resonant capability may be used to obtain the same effects as those in the above linear shapes.

The slit may be formed by subjecting a base plate serving as a ground conductor to a mechanical punch press process, or may be formed by etching.

In the planar array antenna of the present invention, it is preferable that a longitudinal length of the slit 307 is 0.4 to 0.6 of a wavelength at an operating frequency, and more preferably, is about ½ of a wavelength at an operating frequency. The reason is that, if the longitudinal length is set to 0.4 to 0.6, more preferably set to about ½ wavelength, the slit will more easily resonate to emit a high-frequency signal with higher inefficiency so as to reduce a transmission loss. In each of the polygonal slits illustrated in FIG. 11, it is preferable that an overall length of an axis (indicated by the one-dot chain line in FIG. 11) thereof is set to be about ½ of a wavelength at an operating frequency.

In the planar array antenna of the present invention, it is preferable that the patch pattern provided at the position approximately corresponding to the feeder line and the slit in the thicknesswise direction of the planar array antenna has, in the longitudinal direction of the feeder line, a length which is about ¼ to ½ of an effective wavelength (λg) (=(a wavelength λ0 at an operating frequency)/√(a relative permittivity ∈r of a dielectric)). Based on this configuration, it becomes possible to perform sufficient transmission even in relatively rough alignment between the slit and the patch pattern. An actual length of each of the first patch pattern and an after-mentioned second patch pattern is preferably in the range of about 1.0 to 2.0 mm, more preferably in the range of about 1.2 to 1.4 mm, on one side when it has a square shape, or preferably in the range of about 1.0 to 2.0 mm, more preferably in the range of about 1.2 to 1.4 mm, in diameter when it has a circular shape.

Figure 12:
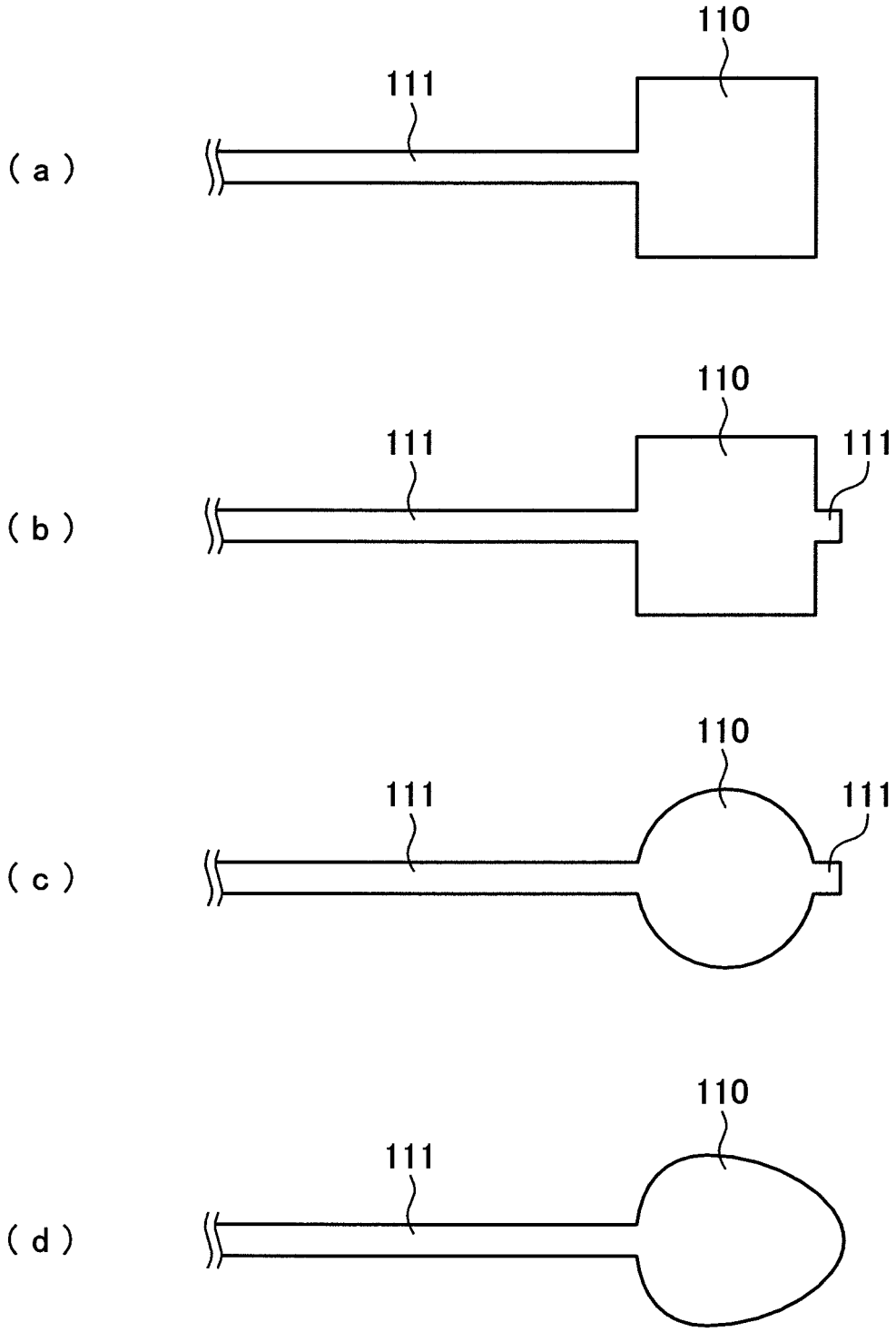
FIG. 12 illustrates, in top plan views, preferred examples of a patch pattern of a planar array antenna according to the present invention.

As a preferred configuration of the patch pattern in the planar array antenna of the present invention, it is preferable that a terminal end of the transmission line is stopped within a square-shaped patch pattern as shown in FIG. 12(*a*). Further, the patch pattern may have a circular shape or may have an ovoid shape as shown in FIG. 12(*d*). Alternatively, the terminal end of the transmission line may protrude from the patch pattern on an opposite side of the transmission line, as shown in FIGS. 12(*b*) and 12(*c*). In this case, it is preferable that a portion of the transmission line away from an edge of the terminal end by a distance of ¼ of the effective wavelength λg is located within the patch pattern.

The transmission line section includes a first shield spacer, a transmission line substrate, a second shield spacer and a second ground conductor, which are arranged in this order. The transmission line substrate has the transmission line and the patch pattern having a width greater than that of the transmission line. The first shield spacer has a hollow portion formed to surround the patch pattern, and the second shield spacer has a hollow portion formed in approximately the same shape as that of the hollow portion of the first shield spacer and at a position corresponding to the hollow portion of the first shield spacer.

Preferably, the hollow portion formed to surround the patch pattern is formed to further surround the transmission line. In this case, in view of suppressing an unwanted propagation mode, it is preferable that the hollow portion has a constricted region between a region surrounding the patch pattern and a region surrounding the transmission line.

More specifically, for example, in a millimeter wave, it is preferable to set the size to allow the hollow portion to be located away from an edge of each of a transmission line 111 and the first patch pattern 110 by a distance of 0.1 λg to 1 λg. If the distance is less than 0.1 λg, a coupling loss between the patch pattern and a slit becomes larger. If the distance is greater than 1 λg, electromagnetic waves will spread out to cause an increase in transmission loss. The symbol "λg" indicates the effective wavelength.

Preferably, the second shield spacer has a thickness approximately equal to that of the first shield spacer, and the first shield spacer has a thickness greater than that of the patch pattern The above structure will be described based on FIG. 13.

Figure 13:
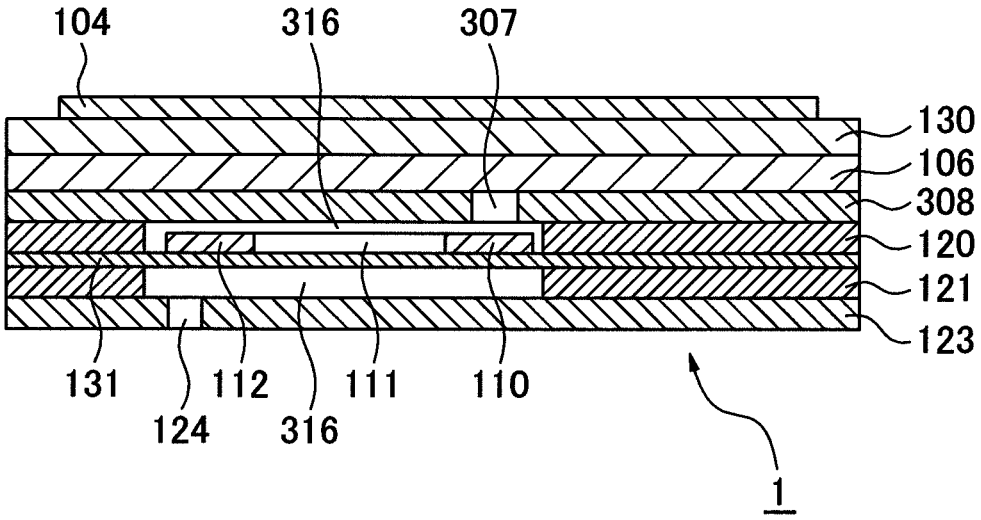
FIG. 13 illustrates, in a sectional view taken along the plane ABCD, the configuration of the planar array antenna illustrated in FIG. 9.

FIG. 13 is a sectional view of a planar array antenna according to one embodiment of the present invention illustrated in FIG. 9, taken along the plane ABCD.

The planar array antenna 1 illustrated in FIG. 13 comprises a first dielectric 106 provided just above a first ground conductor 308 having a slit 307, and an antenna substrate 130 provided with a feeder line 104. The planar array antenna 1 further comprises a first shield spacer 120, a transmission line substrate 131 having a transmission line 111, a second shield spacer 121 and a second ground conductor 123, which are arranged in this order, wherein the first shield spacer 120 is located in opposed relation to the first ground conductor 308. In the planar array antenna 1, the first shield spacer 120 has a hollow portion formed to surround the patch pattern 110, the transmission line 111 and a second patch pattern 112. Each of the first and second shield spacers 120, 121 has a thickness greater than that of the transmission line 111. The second shield spacer 121 has a thickness approximately equal to that of the first shield spacer 120, and has a hollow portion 316 formed in approximately the same shape as that of the hollow portion of the first shield spacer 120. The hollow portion of the second shield spacer 121 having the approximately same shape as that of the hollow portion of the first shield spacer is provided at a position corresponding to the hollow portion of the first shield spacer. Based on providing these hollow portions, an unwanted propagation mode is significantly reduced.

In the structure where the hollow portion is provided in each of the first and second shield spacers 120, 121, the unwanted propagation mode-reduction effect is enhanced, as compared with a structure where the hollow portion is provided in one of the first and second shield spacers 120, 121.

The feeder line 104, the slit 307, and the first patch pattern provided to the transmission line 111, are provided at respective positions approximately corresponding to each other in a thicknesswise direction of the planar array antenna.

As for a positional relationship between the slit 307 and the feeder line 104, in cases where the slit has a polygonal shape, the slit 307 and the feeder line 104 may be arranged to satisfy a positional relationship that they overlap each other in the shaded region illustrated in FIG. 11.

Based on employing the above configuration, it becomes possible to efficiently transmit a high-frequency signal while keeping the occurrence of an unwanted propagation mode low.

In the planar array antenna of the present invention, in view of suppressing the occurrence of an unwanted propagation mode, it is preferable that the slit is located within the hollow portion 316, when viewed in the thicknesswise direction of the planar array antenna.

Further, it is preferable that the second patch pattern 112 and the waveguide opening 124 are located at respective positions corresponding to each other in the thicknesswise direction of the planar array antenna.

Preferably, a line width of the feeder line is set in the range of about 0.2 to 0.5 mm.

The antenna substrate may be prepared by laminating a copper foil on an insulating film as a base material to obtain a flexible substrate, and removing an unnecessary part of the copper foil from the flexible substrate by etching to forming a feed segment, a radiation element and a feeder line or may be prepared using a copper-cladded laminate formed by laminating a copper foil on a thin resin sheet consisting of a glass cloth impregnated with resin. In this case, in view of a lower high-frequency signal transmission loss, it is preferable to use a copper foil having a surface roughness (Ra) of 2 μm or less, i.e., a profile-free copper foil.

Further, as a resin to be used for the copper-cladded laminate, in view of a lower relative permittivity and a lower dielectric loss, it is preferable to use a cyanate resin composition, a cyanate resin-polyphenylene ether resin composition or the like.

Figure 14:
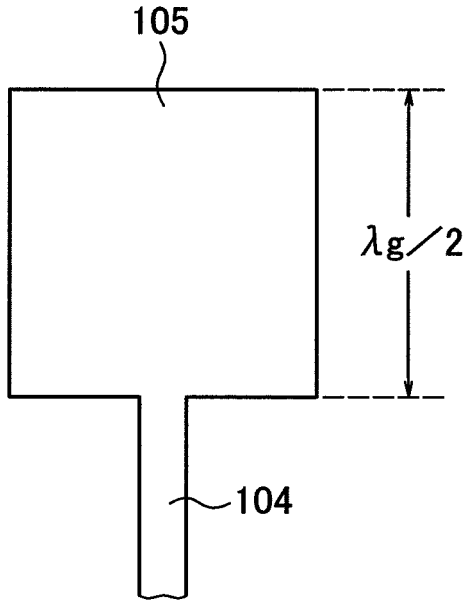
FIG. 14 illustrates an example of connection between a feeder line and a radiation element, and a size of the radiation element, in a planar array antenna according to one embodiment of the present invention.
Figure 14:
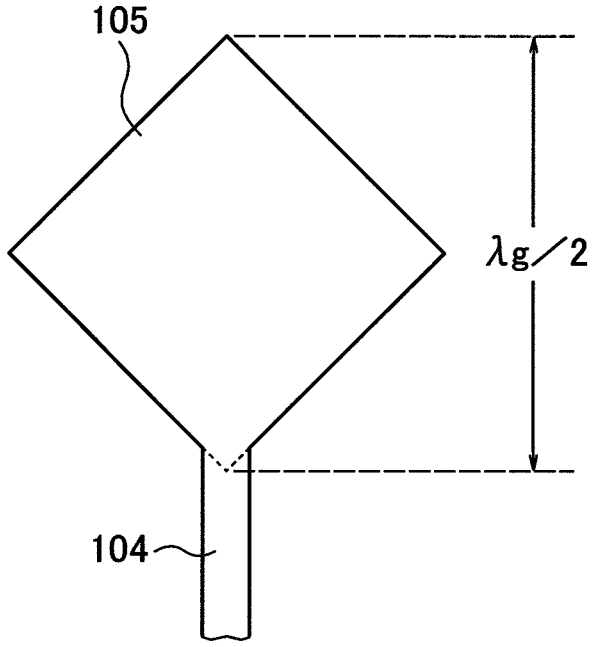

As for a size of the radiation element, it is preferable that a length from a connection point between the radiation element and the feeder line, and an end edge of the radiation element on an extension of the feeder line, so-called a length in an excitation direction, is set to become equal to about ½ of the effective wavelength λg. The radiation element may be formed in a square shape, a rectangular shape, a circular shape, an oval shape or the like. The radiation element will be more specifically described based on a rectangular-shaped radiation element. In cases where the feeder line is connected to a center of one of four sides of the radiation element, it is preferable that a length of the side is set to become equal to ½ of the effective wavelength λg (see FIG. 14(*a*)). In cases where the feeder line is connected to one of four corners of the radiation element at an angle of 45 degrees, it is preferable that a length of a diagonal line of the radiation element is set to become equal to ½ of the effective wavelength λg (see FIG. 14(*b*)). Specifically, an actual size of the radiation element is preferably in the range of about 0.8 to 2.0 mm, more preferably in the range of about 1.0 to 1.4 mm, on one side when it has a square shape.

While a distance between adjacent ones of the radiation elements in the longitudinal direction of the feeder line is dependent on an operating frequency, it is generally preferable to set the distance to 1.0 λ0 (free-space wavelength; wavelength of electromagnetic waves propagated through air) or less. For example, if an operating frequency is 79 GHz, it is preferable to set the distance to 3.8 mm or less.

Preferably, a thickness of the first ground conductor is set in the range of about 0.05 to 1 mm.

Preferably, the planar array antenna of the present invention is configured such that, in the overlap region between the feeder line and the slit formed when viewed in the thicknesswise direction of the planar array antenna, the longitudinal direction of the feeder line becomes approximately perpendicular to a straight line connecting a1 and a2, where: a1 is a midpoint of a straight line which connects an intersection point e between a first one of opposite outer edges of the feeder line extending in the longitudinal direction thereof and a first one of opposite outer edges of the slit, and an intersection point f between the first outer edge of the feeder line and the other, second, outer edge of the slit; and a2 is a midpoint of a straight line which connects an intersection point h between the other, second, outer edge of the feeder line and the first outer edge of the slit, and an intersection point g between the second outer edge of the feeder line and the second outer edge of the slit.

Figure 15:
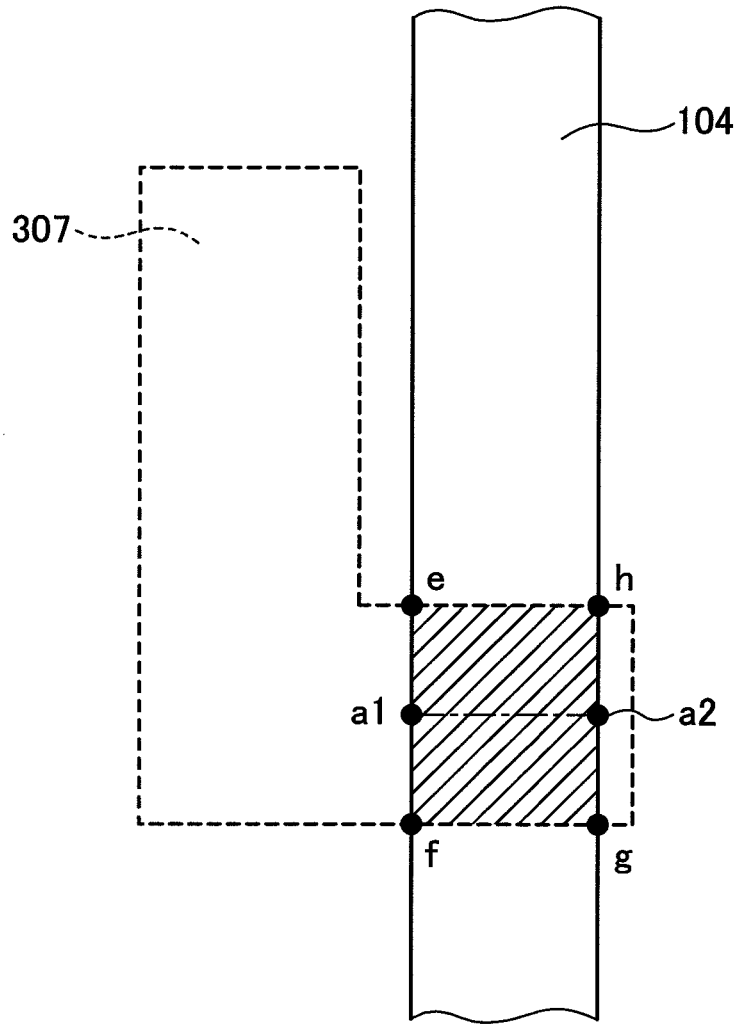
FIG. 15 illustrates, in a top plan view, a positional relationship between a feeder line and a slit provided in a first ground conductor, in a planar array antenna according to one embodiment of the present invention.

The above configuration will be described with reference to FIG. 15. The slit 307 and the feeder line 104 overlap each other in a rectangular region efgh), when viewed in the thicknesswise direction of the planar array antenna. A midpoint of a straight line ef connecting two intersection points between a longitudinal outer edge ef of the feeder line and an outer edge of the slit, i.e., a point e and a point f, is defined as a1, and a midpoint of a straight line gh connecting two intersection points between another longitudinal outer edge gh of the feeder line and the outer edge of the slit, i.e., a point g and a point h, is defined as a2. Under this definition, the planar array antenna is preferably configured such that a straight line connecting a1 and a2 and the longitudinal direction of the feeder line 104 become approximately perpendicular to each other. Base on this configuration, it becomes possible to transmit a high-frequency signal to the feeder line with high efficiency.

Preferably, the overlap region between the feeder line and the slit is located in a position where the number of a first group of the radiation elements connected to the feeder line on one side of the overlap region becomes equal to the number of a second group of the radiation elements connected to the feeder line on the other side of the overlap region. This positional relationship makes it possible to more reduce a variation in beam direction within an operating frequency range. For example, in a planer array antenna illustrated in FIG. 16, the above positional relationship is achieved by an arrangement in which the overlap region between the feeder line and the slit is located in an approximately central region of the feeder line. Given that a wavelength corresponding to an operating frequency is λ, the approximately central region may be offset from a longitudinal center point of the feeder line by about ±λ/8 (equivalent to an actual length of about 1 mm). Further, it is preferable that a feed segment having a width greater than that of the feeder line is provided in the overlap region between the feeder line 104 and the slit.

In the present invention, a preferred operating frequency range may include a frequency range of 77 GHz to 81 GHz.

Figure 16:
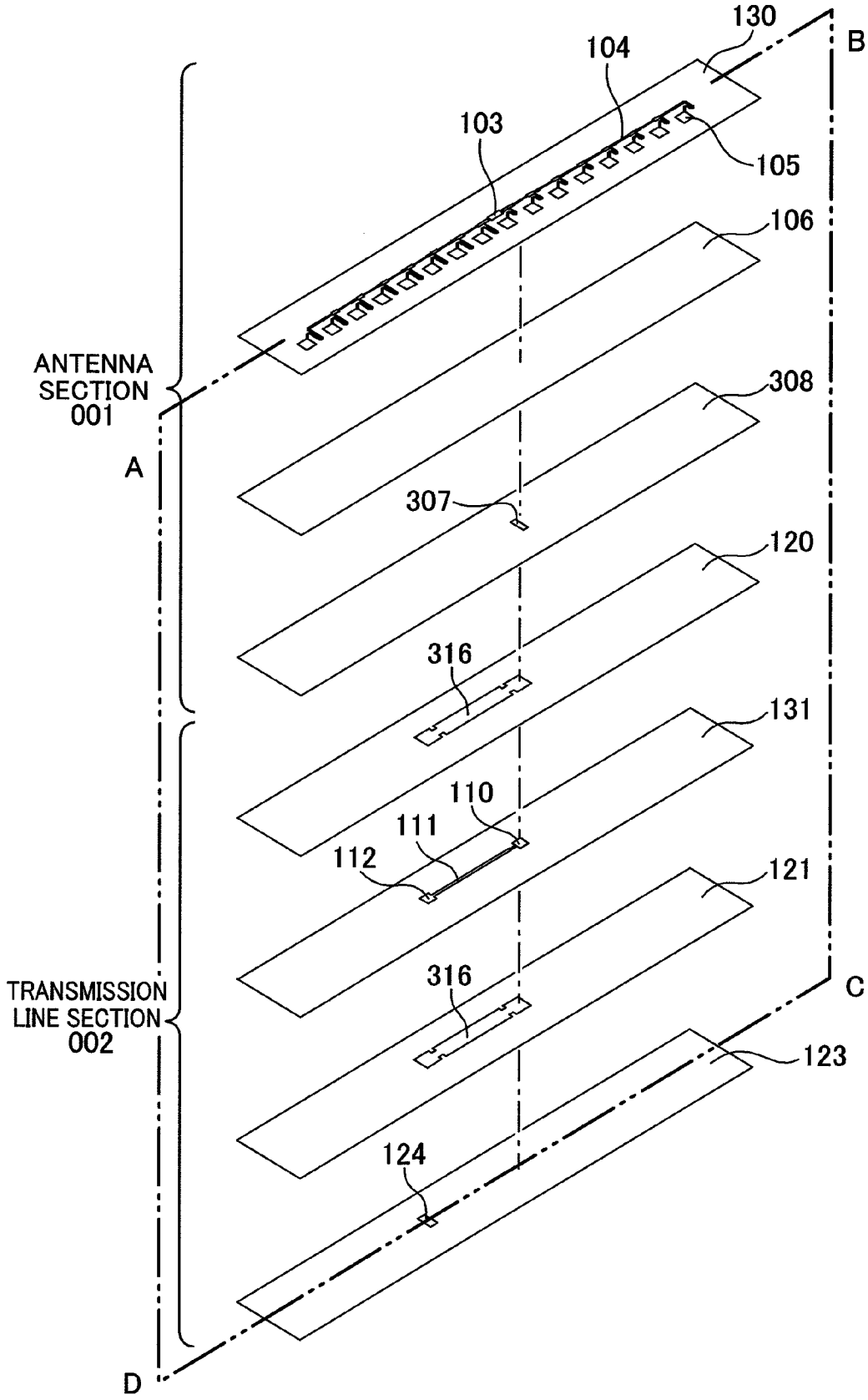
FIG. 16 illustrates, in a perspective view, a configuration of a planar array antenna according to another embodiment of the present invention.
Figure 17:
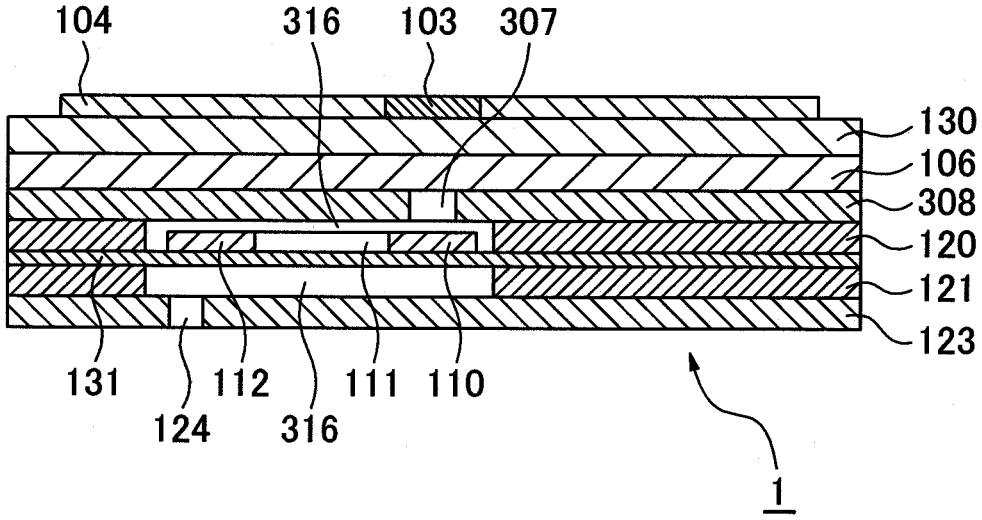
FIG. 17 illustrates, in a sectional view taken along the plane ABCD, the configuration of the planar array antenna illustrated in FIG. 16.

FIG. 16 illustrates a perspective view of a configuration of a planar array antenna according to another embodiment of the present invention, where a feed segment is provided in an appropriately central region of a feeder line. FIG. 17 is a sectional view of the planar array antenna illustrated in FIG. 16, taken along the plane ABCD. With reference to FIGS. 16 and 17, the planar array antenna will be described below.

Except for a future that a feed segment is provided on a feeder line, and a position of the feeder segment is set to an approximately central region on the feeder line, FIG. 16 is substantially the same as FIG. 9. The feature in FIG. 16 is reflected on FIG. 17. In this embodiment, it is preferable that a length of the feed segment in a line direction of the feeder line is about ½ of an effective wavelength λg at an operating frequency.

Preferably, the feed segment, the feeder line and a radiation element are formed from a copper layer, such as a copper foil having a thickness of 10 to 40 μm, by etching or the like.

In cases where the feed segment has a rectangular shape, it is preferable that a length of a long axis thereof is set to be about 0.35 to 0.5, more preferably, set to be about ½ of the effective wavelength λg. Specifically, it is set preferably in the range of about 0.5 to 2.5 mm, more preferably, in the range of about 0.9 to 2.0 mm. Preferably, a length of a short axis of the feed segment is set to be about ⅛ of the effective wavelength λg.

In the planar array antenna according to this embodiment, a phase of a first group of radiation elements on one side of the feed segment 103 is shifted by λ/2 with respect to a phase of a second group of radiation elements on the other side of the feed segment 103. Thus, it is preferable to employ means for phase matching between the first group of radiation elements 105 connected with one side of the feeder line, and the second group of radiation elements 105 connected with the other side of the feeder line. For example, the means for phase matching may include a technique of setting a length of the feeder line between the feed segment and each of the first group of radiation elements to become greater than a length of the feeder line between the feed segment and each of the second group of radiation elements by a value equal to ½ of a wavelength λ corresponding to an operating frequency.

Figure 18:
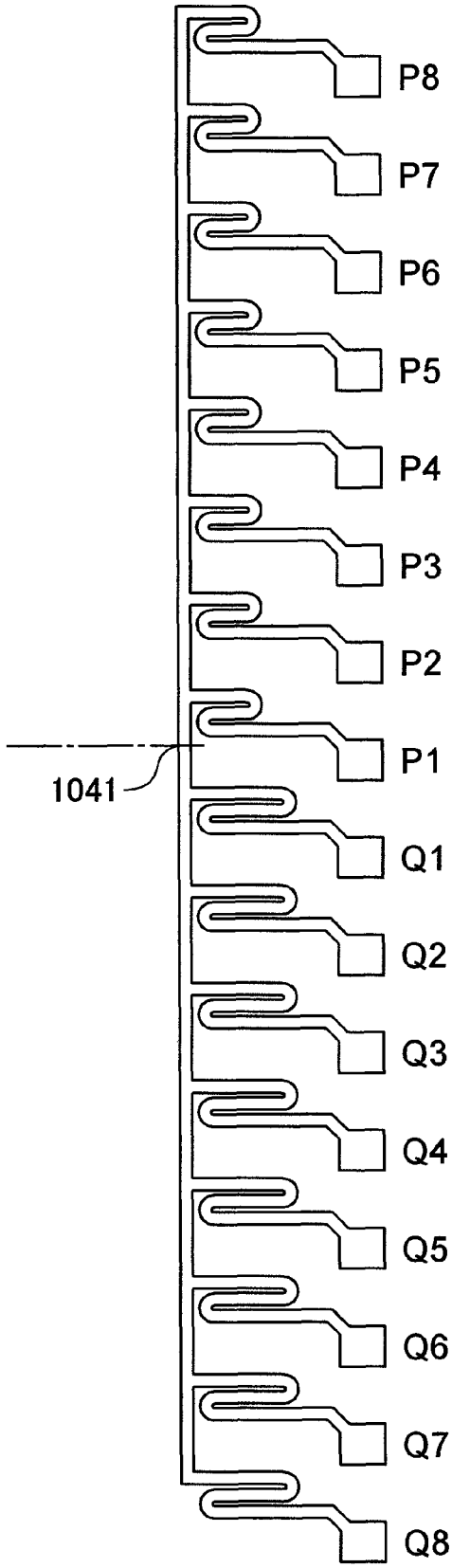
FIG. 18 illustrates an antenna region of a planar array antenna according to the present invention.
Figure 19:
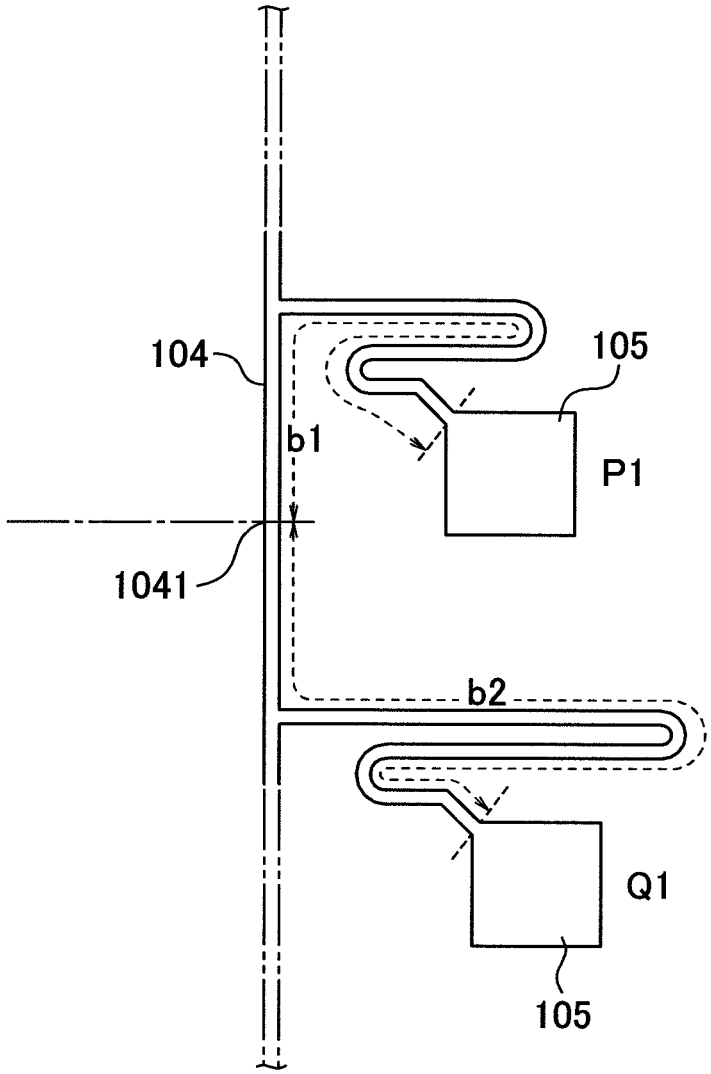
FIG. 19 is an enlarged top plan view showing a portion of a feeder line connected to two radiation elements P1, Q1.

With reference to FIGS. 18 and 19, this technique will be more specifically described.

FIG. 18 is a top plan view of the planar array antenna according to this embodiment, wherein a radiation element Pn (in an radiation element array P) and a radiation element Qn (in an radiation element array Q) (in FIG. 18, n is an integer of 1 to 8) are symmetrically located with respect to the center line of the overlap region (a center of overlap region) 1041 between the feeder line and the slit, on the feeder line. FIG. 19 is an enlarged top plan view of a portion of the feeder line connected to the radiation elements Pn, Qn in FIG. 18. In FIG. 19, a length of the feeder line between the overlap region and the radiation element Pn is defined as b1, and a length of the feeder line between the overlap region and the radiation element Qn is defined as b2. Under this definition, b2 is greater than b1 in terms of a distance from the center line of the overlap region 1041. While there are various techniques for determination on which of b1 for Pn and b2 for Qn should be set to be longer than the remaining one of b1 and b2, it is preferable to set one of b1 and b2 to become greater than the remaining one of b1 and b2 by (a length equal to ½ of a wavelength λ at an operating frequency). For example, in FIG. 19, the length of the feeder line is designed to satisfy the following relation: b1+(a length equal to ½ of a wavelength λ at an operating frequency)=b2.

In the planar array antenna according to the present invention, the ground conductor may be formed using any type of metal plate. In particular, it is preferable to use an aluminum plate. In this case, a lightweight and low-cost ground conductor can be readily prepared.

In the planar array antenna according to the present invention, the transmission line substrate may be prepared by laminating a metal layer, such as a copper foil, on a polyimide film as a base material to obtain a flexible substrate, and removing an unnecessary part of the metal layer from the flexible substrate by etching to form a first patch pattern, a transmission line and a second patch pattern thereon. In this case, the etching of the metal layer may be limited to a portion of the metal layer around the first patch pattern, the transmission line and the second patch pattern. In view of suppressing a propagation loss, it is preferable to form an outer periphery of the etched region to have a shape conforming to that of a hollow portion in each of two shield spacers provided just above and beneath the transmission line substrate. The transmission line substrate may also be prepared using a copper-cladded laminate formed by laminating a copper foil on a thin prepreg sheet consisting of a glass cloth impregnated with resin. As for the copper foil, in view of a lower high-frequency signal transmission loss, it is preferable to use a copper foil having a surface roughness (Ra) of 2 μm or less, i.e., a profile-free copper foil. Further, as a resin to be used for the copper-cladded laminate, in view of a lower relative permittivity and a lower dielectric loss, it is preferable to use a cyanate resin composition, a cyanate resin-polyphenylene ether resin composition or the like.

Preferably, a thickness of the base material, such as a polyimide film, of the transmission line substrate 131, is set in the range of about 50 to 150 μm.

Preferably, a line width of the transmission line is set in the range of about 0.1 to 0.4 mm.

Preferably, a distance between an outer periphery of each of the first patch pattern, the transmission line and the second patch pattern, and an inner periphery of the hollow portion provided in each of the shield spacers is set in the range of about 0.3 to 1.5 mm.

Preferably, a thickness of each of the first patch pattern, the transmission line and the second patch pattern is set in the range of about 10 to 40 μm.

Preferably, a thickness of each of the first shield spacer 120 and the second shield spacer 121 is set in the range of about 0.2 to 0.5 mm.

In the planar array antenna according to the present invention, it is preferable that the waveguide opening 124 is provided in the second ground conductor 123 at a position approximately corresponding to the second patch pattern, when viewed in the thicknesswise direction of the planar array antenna.

In the planar array antenna provided the feed segment 103, the feed segment 103 of the antenna substrate 130, the slit of the first ground conductor, and the first patch pattern 110 of the transmission line substrate 131, are located to overlap each other, when viewed in the thicknesswise direction of the planar array antenna, which makes it possible to suppress the occurrence of an unwanted propagation mode. Specifically, a center of the slit or a center of the first patch pattern 110 may be disposed to fall within the range of ±⅛ of a wavelength λ corresponding to an operating frequency (which is equivalent to an actual length of about 1 mm) from an intersection point between a perpendicular line extending from a center point of the feed segment 103 and the transmission line substrate 131. This makes it possible to produce the antenna without spoiling antenna characteristics, even in relatively rough alignment, so as to provide excellent productivity.

The principle of electromagnetic coupling between the first patch pattern 110 and the feed segment 103 will be described below. When the first patch pattern is excited to resonate, it acts as a resonator to accumulate a high-frequency signal. Then, the high-frequency signal is emitted from the first patch pattern toward the slit 307. The slit 305 also acts as a resonator to accumulate the high-frequency signal. The high-frequency signal accumulated in the slit 307 is emitted to the feed segment 103, so that transmission of the high-frequency signal from the first patch pattern to the feed segment 103 is achieved.

Preferably, a thickness of the second ground conductor is set in the range of about 0.05 to 1 mm.

Figure 20:
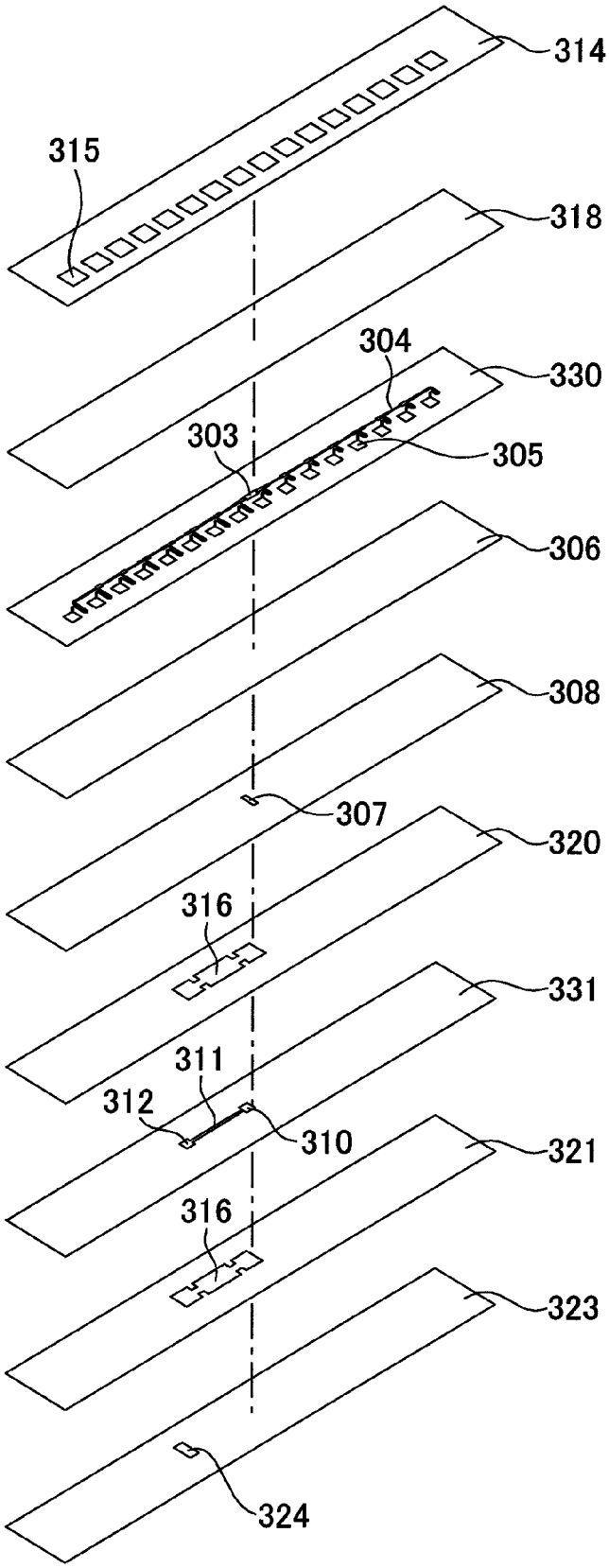
FIG. 20 illustrates, in a perspective view, a configuration of a planar array antenna according to yet another embodiment of the present invention.

As for the waveguide opening 124, a size defined by the EIA standards for each operating frequency band is typically used. For example, in the frequency band 75 to 110 GHz, the size is 2.54 mm×1.27 mm. In the embodiment illustrated in FIG. 16, the antenna section is formed using a microstrip structure. For example, as shown in FIG. 20, a dielectric 318 and a third ground conductor 314 having an array of slot openings 315 may be provided above the antenna substrate 330 at a position approximately corresponding to the radiation elements 305 to form a triplate structure, so as to obtain a planer array antenna having a higher gain. In this case, a thickness of the dielectric 318 is preferably set in the range of about 0.2 to 0.5 mm, and a thickness of the third ground conductor 314 is preferably set in the range of about 0.05 to 1 mm.

As used in the present invention, the third ground conductor 314 having the slot openings 315 may be prepared using a metal plate or a plastic plate subjected to plating. In particular, it is preferable to employ an alumina plate, because a lightweight and low-cost ground conductor or shield spacer can be readily prepared. Alternatively, the third ground conductor may be prepared by laminating a metal layer, such as a copper foil, on a film as a base material to obtain a flexible substrate, removing an unnecessary part of the copper foil from the flexible substrate by etching, and forming a slot opening above a dielectric, or may be prepared using a copper-cladded laminate formed by laminating a copper foil on a thin prepreg sheet consisting of a glass cloth impregnated with resin, to obtain the same structure. While a basis shape of the slot may be any type, such as a quadrangular shape, a triangular shape, a polygonal shape, a circular shape or an oval shape, it is preferable to form the slot in conformity to a shape of the radiation element.

Figure 21:
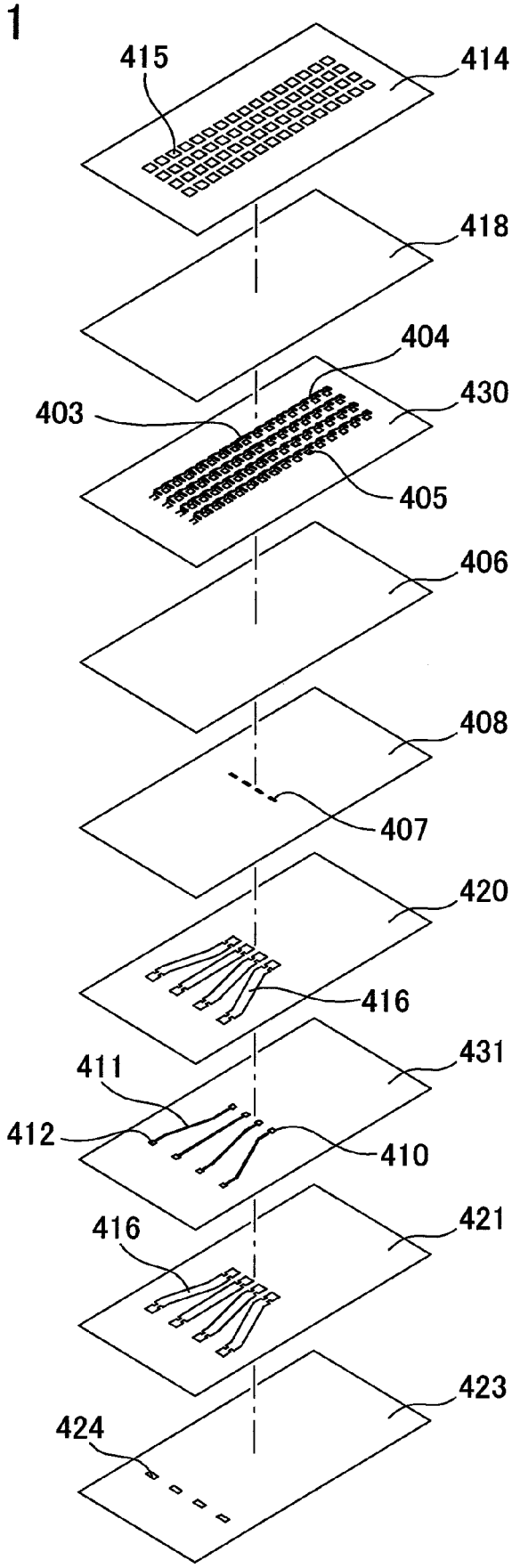
FIG. 21 illustrates, in a perspective view, a configuration of a planar array antenna according to still another embodiment of the present invention.

Further, as shown in FIG. 21, a plurality of rows of the antenna regions may be provided. In this case, a plurality of the transmission line sections each including the first patch pattern, the transmission line and the second patch pattern, and a plurality of the waveguide openings, are provided correspondingly to the number of the rows of antenna regions. When the planar array antenna of the present invention is used as a radar, the rows of antenna regions provided therein contribute to improvement in detection accuracy of the radar.

In the planar array antenna provided with the rows of antenna regions, a metal zone 108 (see, for example, FIG. 22A) may be provided between adjacent ones of the rows of antenna regions of the antenna substrate. In this case, an isolation-improvement effect based on after-mentioned hollow portions can be advantageously enhanced.

Figure 22:
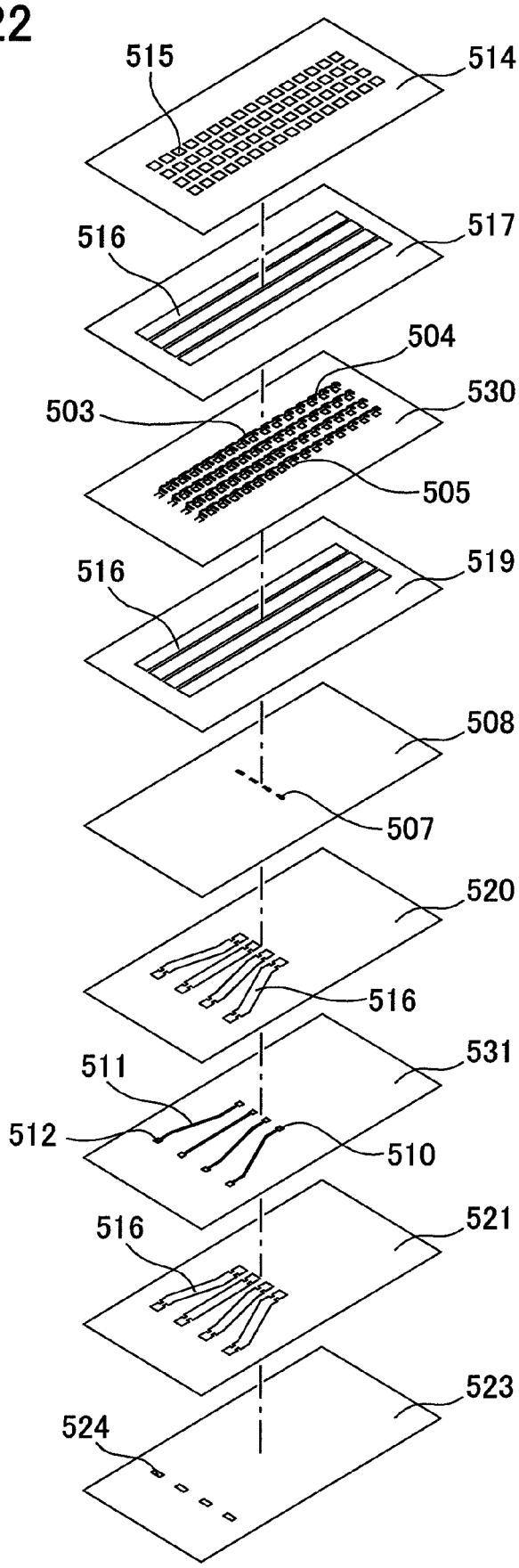
FIG. 22 illustrates, in a perspective view, a configuration of a planar array antenna according to yet still another embodiment of the present invention.
Figure 22A:
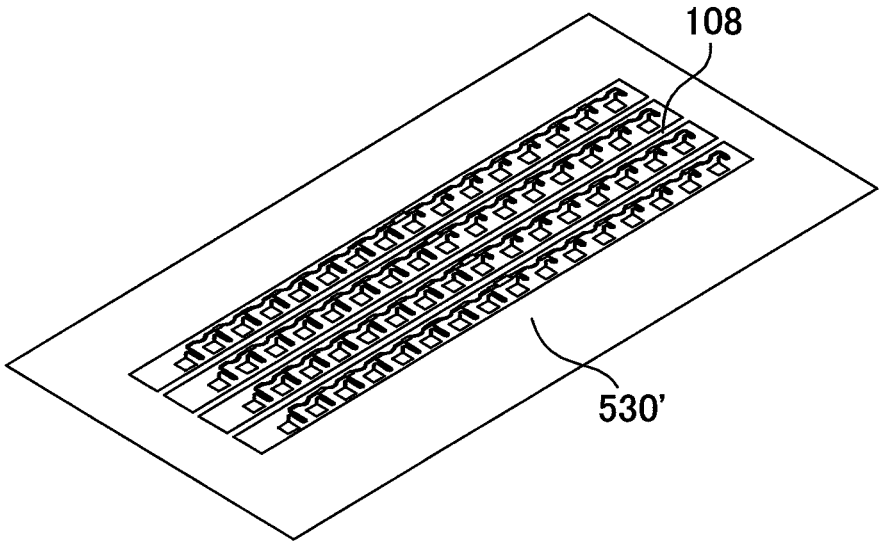
FIG. 22A illustrates, in an enlarged form, another example of a component of the planar array antenna illustrated in FIG. 22.

Further, as shown in FIG. 22, third and fourth shield spacers 517, 519 each provided with a plurality of hollow portions 516 at positions approximately corresponding to respective ones of the rows of antenna regions may be disposed at respective positions just above and beneath the antenna substrate having the rows of antenna regions, which advantageously provides enhanced isolation. Each of the hollow portions 516 may have a size larger than that of a respective one of the rows each comprising an array of the radiation elements 505.

The hollow portions 516 of the shield spacer 519 have the same function as that of the dielectric layer in FIG. 9 or FIG. 16. An urethane foam sheet having a shape corresponding to that of the hollow portions (and a thickness approximately equal to that of the shield spacer 519) may be filled in the hollow portions 516 so as to more stably hold the antenna substrate 530. In the same manner, an urethane foam sheet may be filled in the hollow portions 516 of the shield spacer 517.

Figure 22B:
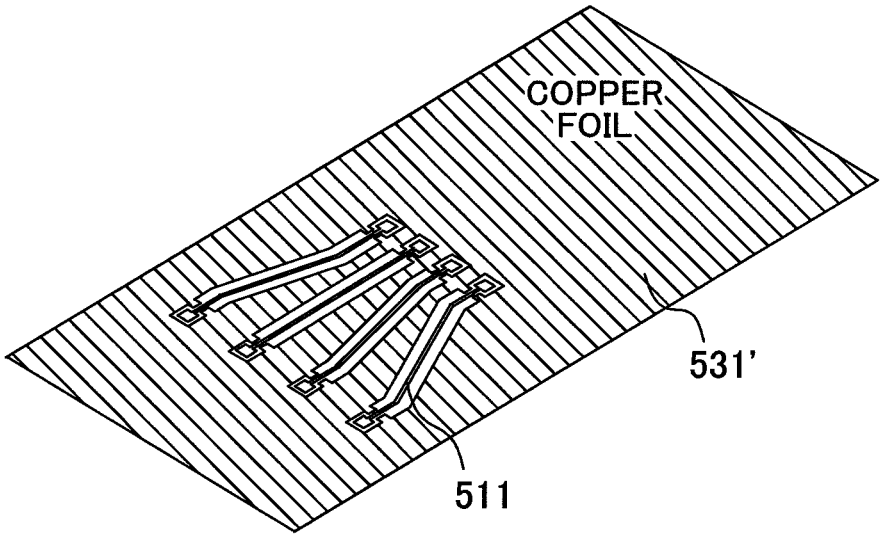
FIG. 22B illustrates, in an enlarged form, another example of a component of the planar array antenna illustrated in FIG. 22.

FIG. 22 shows the transmission line substrate 531 having thereon four connected bodies each consisting of the first patch pattern 510, the transmission line 511 and the second patch pattern 512, wherein there is no conductive layer around each of the connected bodies. However, in cases where the transmission line 531 is formed, for example, using a substrate having a metal layer, such as a copper foil, and a dielectric, by an ordinary method such as photolithograph, etching of the metal layer may be limited to a portion of the metal layer around the first patch pattern 510, the transmission line 511 and the second patch pattern 512. In view of suppressing a propagation loss, it is preferable to form an outer periphery of the etched region to have a shape conforming to that of each of the hollow portions in each of the shield spacers provided just above and beneath the transmission line substrate (this type of transmission line substrate 531 is shown in FIG. 22B).

The planar array antenna of the present invention provided in the above manner, for example, to have four rows of radiation element arrays, can be formed in a small, lightweight and thin structure having a width of about 3 cm, a length of about 7 cm and a thickness of about 0.8 to 6 cm, in terms of an overall size (in top plan view).

In the following Examples, an example designed on an assumption that an operating frequency is in the range of 75 to 83 GHz is shown.

EXAMPLE 3

One example of the planar array antenna according to the present invention is shown in FIG. 16. In FIG. 16, the antenna substrate included in the antenna section was prepared by laminating a copper foil having a thickness of 18 μm on a polyimide film having a thickness of 25 μm to form a film substrate, and removing an unnecessary part of the copper foil from the film substrate by etching to form thereon a radiation element having a size of 1.25 mm×1.25 mm (single array consisting of 16 radiation elements; interval of the radiation elements=3.6 mm), a feeder line connecting between each of the radiation elements 105 in the radiation element array and an after-mentioned feed segment (line width=0.3 mm), and a feed segment 103 in a central region of the radiation element array (rectangular shape; long axis=1.8 mm; short axis=0.4 mm). The feed segment 103 was formed such that the long axis becomes parallel to a longitudinal direction of the feeder line 104.

In the same manner, the transmission line substrate was prepared by laminating a copper foil having a thickness of 18 μm on a polyimide film having a thickness of 25 μm to form a film substrate, and removing an unnecessary part of the copper foil from the film substrate by etching to form thereon a first patch pattern (size=1.3 mm×1.3 mm), a transmission line (line width=0.3 mm), and a second patch pattern (size=1.3 mm×1.3 mm).

Further, the first ground conductor 308 was prepared by subjecting an aluminum plate having a thickness of 0.3 mm to a punch press process while forming therein a slit 307 (size=1.8 mm×1.8 mm). An aluminum plate formed to have a thickness of 0.3 mm and provided with a hollow portion for surrounding an antenna region was sandwiched between the first ground conductor 308 and the antenna substrate, and air was used as the first dielectric 106. For example, the first dielectric 106 may also be formed by providing a spacer between the first ground conductor 308 and the antenna substrate 130 to an extent that there is no negative impact on antenna characteristics.

In the same manner, the first shield spacer 120 (thickness=0.3 mm) and the second shield spacer (thickness=0.3 mm) were prepared in such a manner that each of them has a hollow portion 316 larger than a transmission line region (size of a part of the hollow portion on each of the first and second patch patterns=2.4 mm×2.4 mm; width of a part of the hollow portion on the transmission line=1 mm).

In this same manner, the second ground conductor 123 (thickness=0.3 mm) was prepared by subjecting an aluminum plate having a thickness of 0.3 mm to a punch press process while forming therein a waveguide opening at a position overlapping the second patch pattern 112.

The antenna substrate (thickness=25 μm), the first dielectric 106 (thickness=0.3 mm), the first ground conductor 308 (thickness=0.3 mm), the first shield spacer 120 (thickness=0.3 mm), the transmission line substrate 131 (thickness=25 μm), the second shield spacer 121 (thickness=0.3 mm) and the second ground conductor 123 (thickness=0.3 mm) were layered in this order, and fastened by a rivet or the like to form the planar array antenna (size=114 mm×30 mm; overall thickness=about 1.55 mm).

The transmission line region is received in a region of the hollow portions 316 of the first shield spacer 120 and the second shield spacer 121 provided just above and beneath the transmission line substrate 131, and held between the two hold portions. A half of the feeder line and the eight radiation elements are formed on each of both sides of the feed segment 103. Typically, the radiation elements 105 are provided on each of both sides of the feed segment 103 in the same number. In other words, in this example of the planar array antenna according to the present invention, the feed segment 103 is provided in an approximately central region of the array of radiation elements 105.

Figure 23:
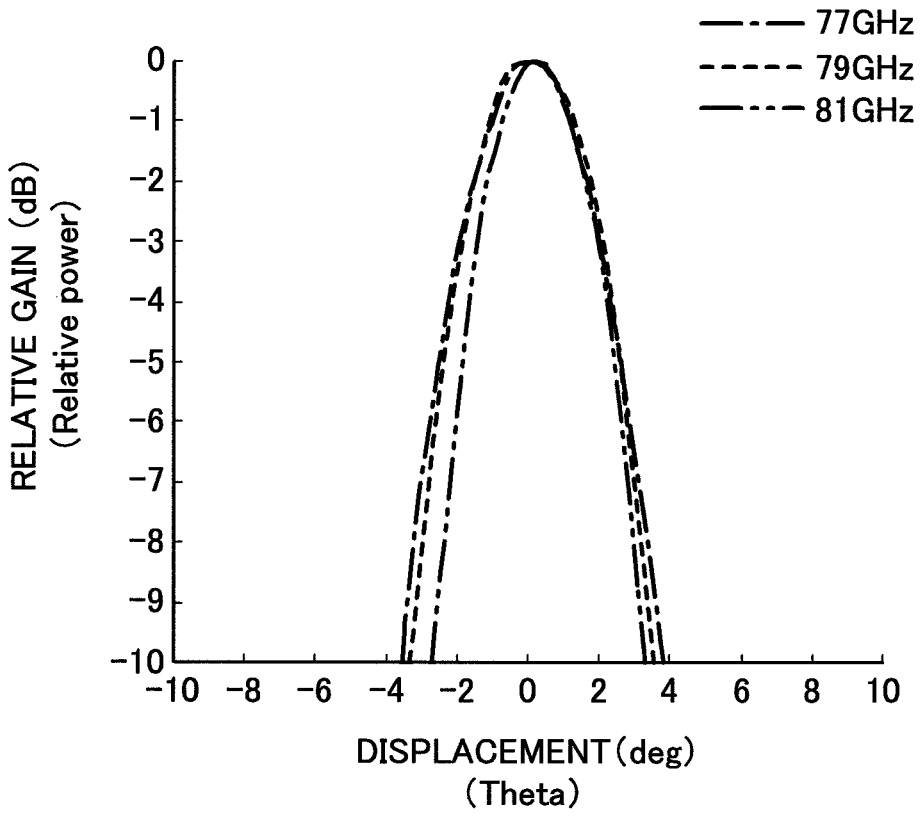
FIG. 23 illustrates characteristics of a planar array antenna according to the present invention.

The above members were layered one on top of the other as shown in FIG. 16 to form the planar array antenna. In order to evaluate characteristics of the planar array antenna, a vertical directionality in the range of 77 GHz to 81 GHz was measured at intervals of 2 GHz, i.e., at three points 77 GHz, 79 GHz, 81 GHz. As a result, the characteristic as shown in FIG. 23 was obtained. In FIG. 23, on an assumption that an angle of a direction perpendicular to a surface of the antenna substrate of the planar array antenna is zero degree, a displacement (θ) relative to the direction is plotted on the horizontal axis. The vertical axis represents a relative gain. On an assumption that a measurement value having the largest gain is zero, the relative gain is indicated by a relative value with respect to the measurement value. Thus, it is most desirable that the relative gain is zero dB when the displacement is zero. Further, a characteristic that a reduction rate of the relative gain is greater than an increase rate of the angular displacement, indicates that the antenna has a strong vertical directionality, i.e., a desirable characteristic. The result will be described later.

Figure 24:
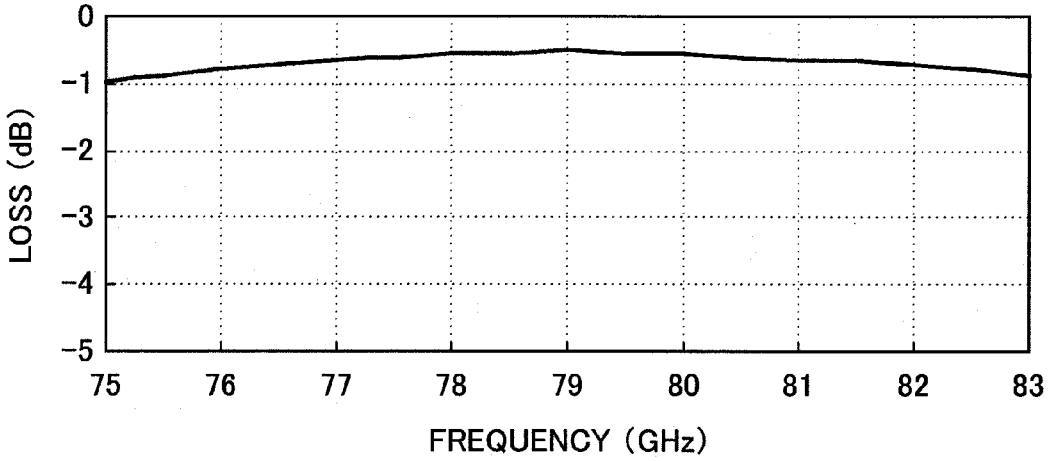
FIG. 24 illustrates characteristics of a planar array antenna in Example 3.

Further, a transmission loss between the feed segment and the first patch pattern of the planar array antenna was analyzed using a high-frequency three-dimensional electromagnetic field simulator HFSS (trade name; produced by Ansoft Corporation). The result is shown in FIG. 24. In this analysis, a relative permittivity ∈r of the dielectric in the hollow portion was assumed as 1.03. The dimensions described in Example 3 were used as dimensions of a model. In the analyzed frequency band 75 to 83 GHz, the transmission loss was sufficiently reduced to −1 dB or less.

EXAMPLE 4

Another example of the planar array antenna according to the present invention will be described based on FIG. 20.

Except that the first dielectric 318 is provided just above the antenna substrate 330, and the third ground conductor (slotted plate) 314 (thickness=0.3 mm) having the array of slot openings (each size=2.3 mm×2.3 mm) each having a size larger than that of a respective one of the array of radiation elements 305 on the antenna substrate 330 in the antenna section is provided just above the first dielectric 318 and at a position corresponding to the array of radiation elements 305, each member was prepared in the same manner as that for the Example 3, and formed in the structure illustrated in FIG. 20.

Figure 25:
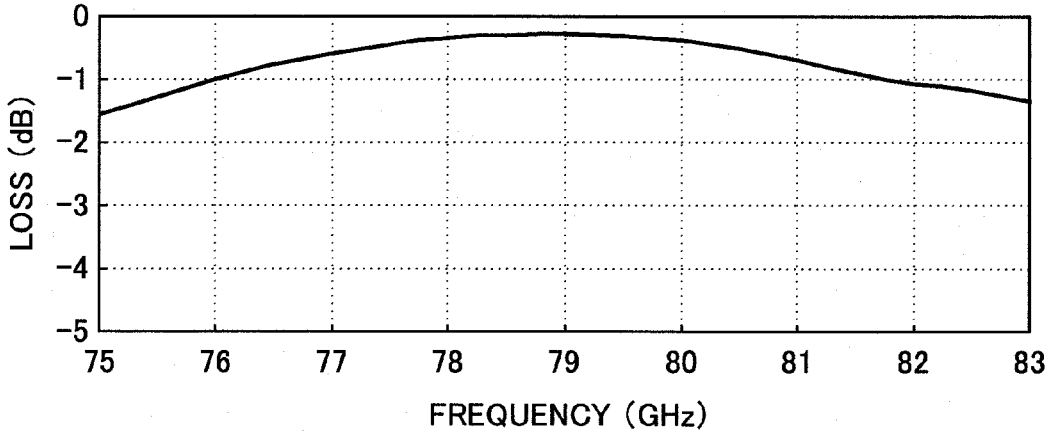
FIG. 25 illustrates characteristics of a planar array antenna in Example 4.
Figure 26:
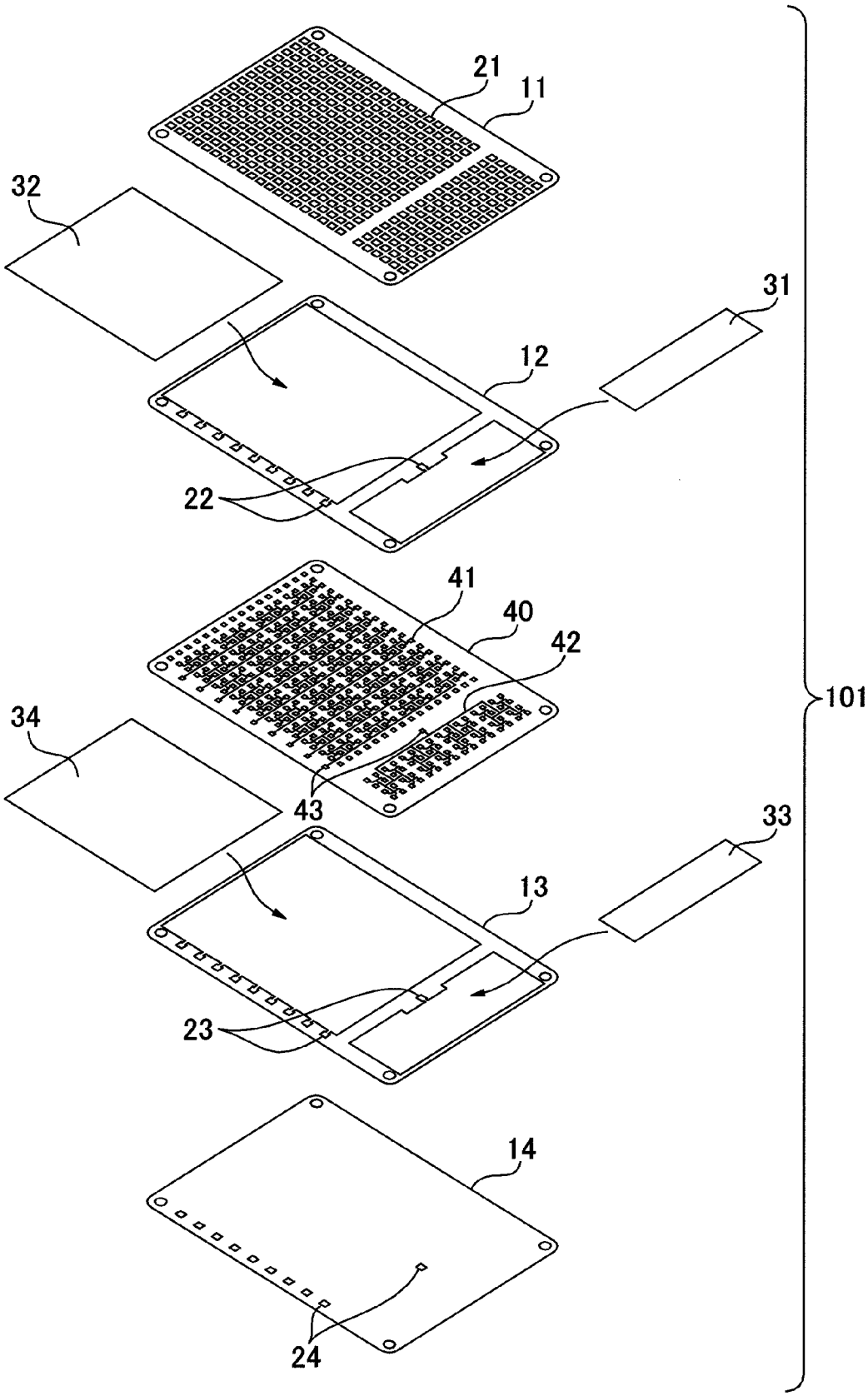
FIG. 26 illustrates FIG. 5 shown in the Patent Document 2.
Figure 27:
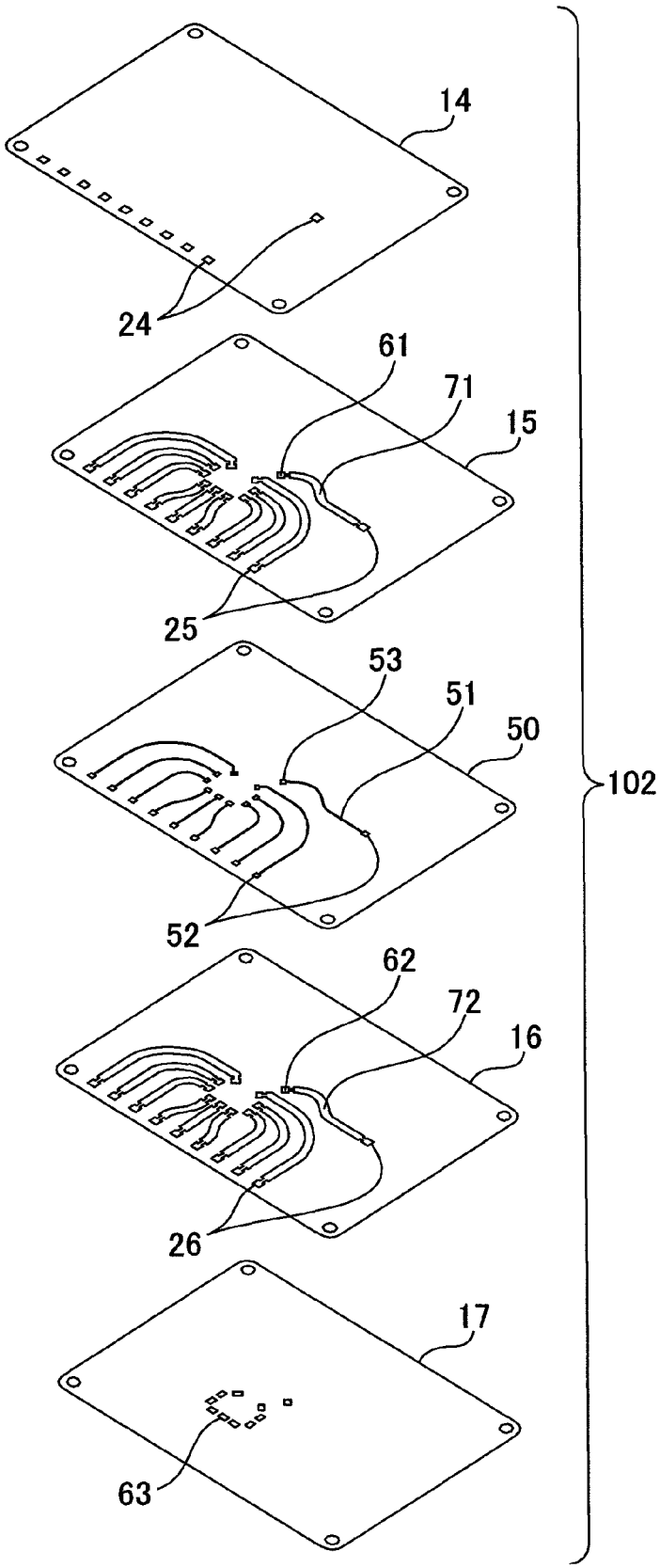
FIG. 27 illustrates FIG. 7 shown in the Patent Document 2.

As above, the second ground conductor 323, the second shield spacer 321, the transmission line substrate 331, the first shield spacer 320, the first ground conductor 308, the first dielectric 306, the antenna substrate 330, the second dielectric 318 and the third ground conductor 314 were layered upwardly in this order to form the planar array antenna as shown in FIG. 20. In order to evaluate characteristics of the planar array antenna, a vertical directionality in the range of 77 GHz to 81 GHz was measured at intervals of 2 GHz, i.e., at three points 77 GHz, 79 GHz, 81 GHz. As a result, it was proven that a frequency-dependent shift of a beam direction is improved, and, as compared with the Example 3, a similar vertical directionality and a higher gain by about 2 dB are obtained. Further, a transmission loss between the feed segment and the first patch pattern of the planar array antenna was analyzed using a high-frequency three-dimensional electromagnetic field simulator HFSS (trade name; produced by Ansoft Corporation). The result is shown in FIG. 25. In the frequency band 75 to 83 GHz, the transmission loss was sufficiently reduced to −1 dB or less. Particularly, in the frequency range of 78 to 80 GHz, the transmission loss was extremely reduced to −0.5 dB or less.

EXAMPLE 5

Still another example of the planar array antenna according to the present invention will be described based on FIG. 21.

Except that a plurality of sets of the waveguide opening 424, the first patch pattern 410, the transmission line 411, the hollow portion, the slit 407, the antenna region, and the slot opening 415 larger than each of the radiation elements 405 are provided, and each of the transmission line and the hollow portion is provided in a slightly curved manner, each member was prepared in the same manner as that for the Example 4, and formed in the structure illustrated in FIG. 21.

In order to evaluate characteristics of the planar array antenna illustrated in FIG. 21, a vertical directionality in the range of 77 GHz to 81 GHz was measured at intervals of 2 GHz, i.e., at three points 77 GHz, 79 GHz, 81 GHz. As a result, it was proven that, in the structure formed with a plurality channels, a frequency-dependent shift of a beam direction is improved, and excellent characteristics similar to those in the Example 4 are obtained. The isolation between adjacent antennas was about 15 dB. As above, as long as a 4-row planar array antenna is produced according to the technique of this example, excellent characteristics without frequency-dependent shift of a beam direction can be obtained. Further, the arrangement of the plurality of rows of radiation element arrays according to the technique of this example is more effective in reducing an area of the antenna substrate, as compared with a conventional structure.

EXAMPLE 6

Yet another example of the planar array antenna according to the present invention will be described based on FIG. 22.

Except that the third shield spacer 517 and the fourth shield spacer 519 each having the hollow portions 516 each having a size (75 mm×3.9 mm) larger than a respective one of the antenna regions, correspondingly to a respective one of the antenna regions, are provided at respective positions just above and beneath the antenna substrate 330, each member was prepared in the same manner as that for the Example 5, and formed in the structure illustrated in FIG. 22.

In order to evaluate characteristics of the planar array antenna illustrated in FIG. 22, a vertical directionality in the range of 77 GHz to 81 GHz was measured at intervals of 2 GHz, i.e., at three points 77 GHz, 79 GHz, 81 GHz. As a result, it was proven that, in the structure formed with a plurality channels, a frequency-dependent shift of a beam direction is improved, and a directionality and a gain similar to those in the Example 5 are obtained. The isolation between adjacent antennas was about 30 dB, which is superior to the Example 5. As above, as long as a 4-row planar array antenna is produced according to the technique of this example, excellent characteristics without frequency-dependent shift of a beam direction can be obtained, and interference (isolation) of a high-frequency signal from an adjacent antenna can be reduced by the first shield spacer 517 and the second shield spacer 519 to provide a planar array antenna having a high isolation capability. Further, the arrangement of the plurality of rows of radiation element arrays according to the technique of this example is more effective in reducing an area of the antenna substrate, as compared with a conventional structure.

Although the approximately center (central region) of the feed segment 503 in the Example 4 is formed in a quadrangular shape, it may be formed in an oval shape to obtain the same excellent characteristics as those in the Example 3. Further, in cases where a quadrangular or oval-shaped feed segment cannot be provided due to constraints of wiring space, the feed segment may be formed to have a width simply passing over the slit, while taking into account an impedance of a high-frequency signal from the slit and an impedance of the feeder line 104.

Although the second patch pattern 512 in the Example 4 is formed in a quadrangular shape, it may be formed in a triangular or circular shape, as with the radiation element, to obtain the same excellent characteristics as those in the Example 3.

Although the slit 507 in the Example 4 is formed in a quadrangular shape, it may be formed in an L shape, an angular U shape or an H shape, as shown in FIG. 11, to obtain the same excellent characteristics as those in the Example 3. The feed segment may be arranged to allow a center thereof to be aligned with a center of each of the slits illustrated in FIG. 11 so as to obtain more desirable characteristics.

COMPARATIVE EXAMPLE 1

Figure 28:
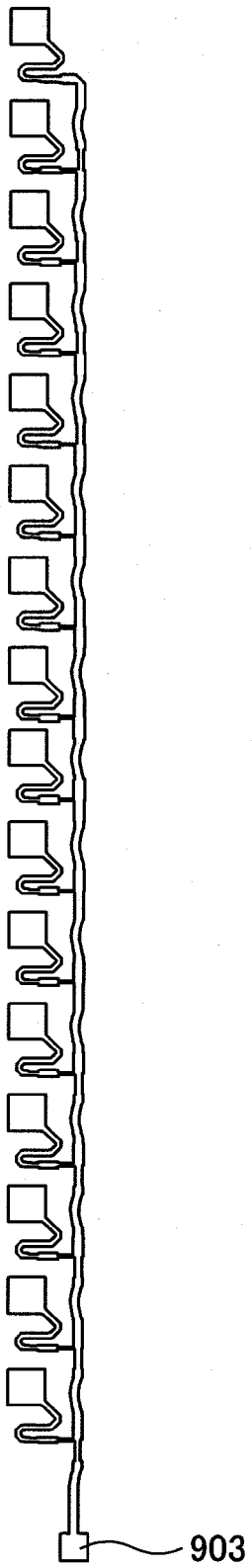
FIG. 28 schematically illustrates an antenna region in which a feed segment is provided at a lower end of a radiation element array of a planar array antenna in Comparative Example 1.

Except that the antenna region in the Example 3 is substituted with an antenna region having a configuration illustrated in FIG. 28, and a feed segment 903, the slit 307 and the first patch pattern are disposed to approximately overlap each other when viewed in a thicknesswise direction of a planar array antenna, each component was prepared in the same manner as that in the Example 3.

Figure 29:
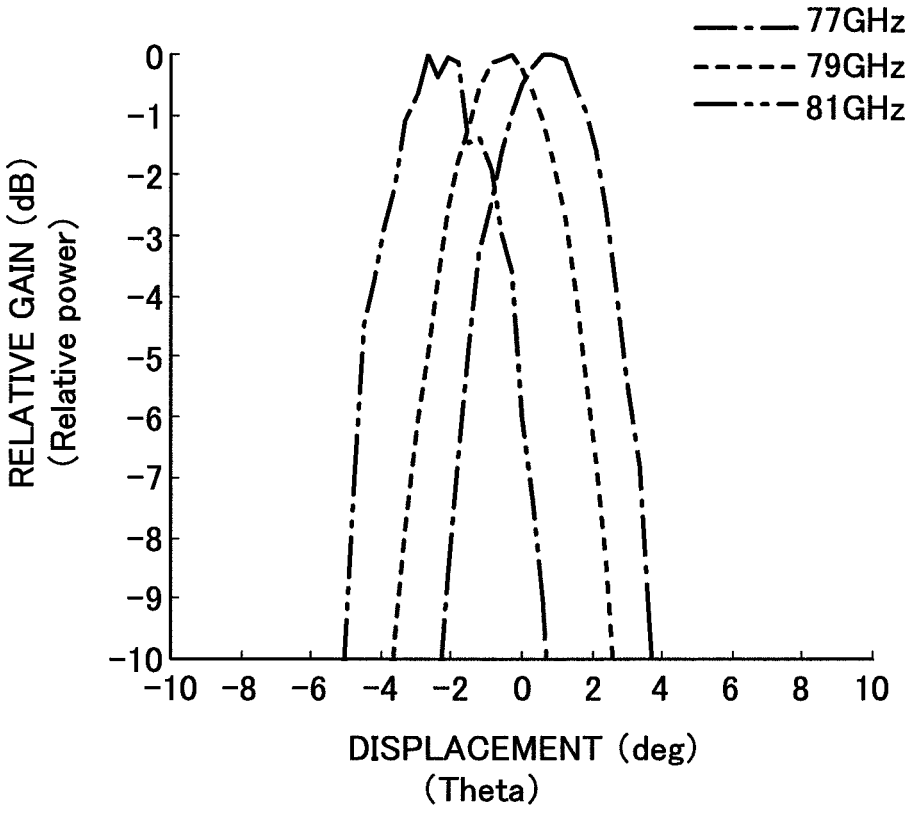
FIG. 29 illustrates characteristics of the planar array antenna in Comparative Example 1.

In order to evaluate characteristics of this planar array antenna, a vertical directionality in the range of 77 GHz to 81 GHz was measured at intervals of 2 GHz, i.e., at three points 77 GHz, 79 GHz, 81 GHz. As a result, a characteristic as shown in FIG. 29 was obtained.

In the planar array antenna, a feeder line is neither formed to have a constant line width nor laid to have a fully straight shape, due to a variation in production conditions. However, even in this case, it is possible to determine a longitudinal direction of the feeder line. For example, two hypothetical parallel lines (not shown) can be set such that they extend while keeping an average width dm of the feeder line therebetween, i.e., they are spaced apart rightwardly and leftwardly from a centerline of the feeder line by dm/2. These lines can be handled as a virtual feeder line in the same manner as that for the feeder line 104 having a constant width as shown in FIG. 16, and respective shapes and positions of the slit and the virtual feeder line can be adjusted to satisfy a relationship that the line connecting a1 and a2 becomes approximately perpendicular to a longitudinal direction of the virtual feeder line.

As seen in the result of the Comparative Example 1, only a frequency is increased/reduced by 2 GHz, and a displacement of an angle at a relative gain peak occurs. This means that an optimal detection angle varies depending on an operating frequency. In contract with the result of the Comparative Example 1, the result of the Example 3 shows that relative gain peaks approximately overlap each other irrespective of a change in frequency, i.e., a frequency-dependent shift of a beam direction is improved, and excellent characteristics are achieved.

COMPARATIVE EXAMPLE 2

Figure 30:
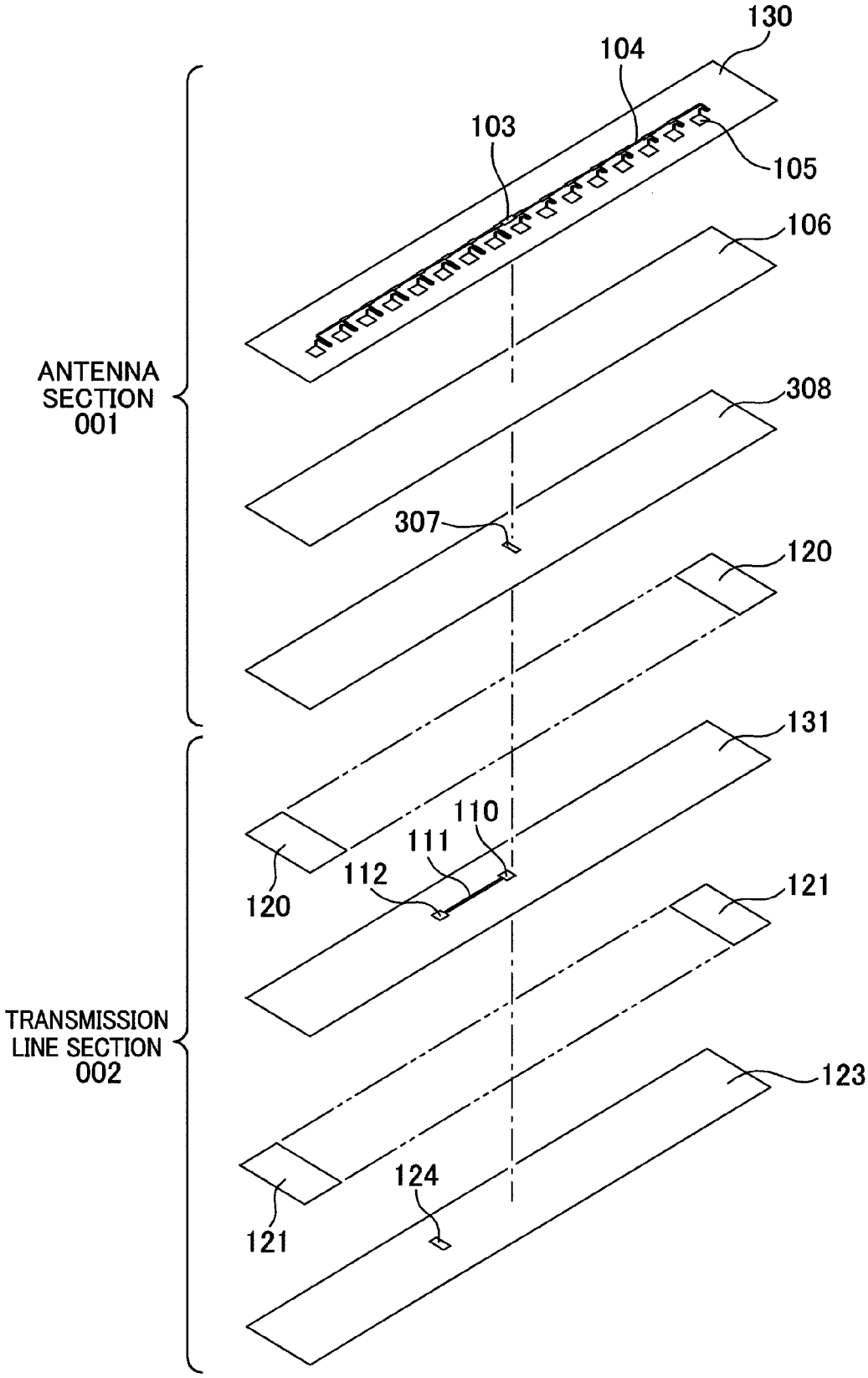
FIG. 30 illustrates, in a perspective view, a configuration of a planar array antenna in Comparative Example 2.

FIG. 30 illustrates a perspective view of a configuration in Comparative Example 2. Except that each of first and second shield spacers just above and beneath the transmission line substrate 131 of the planar array antenna according to the present invention in FIG. 16 illustrating a configuration identical to that of the Example 3 is formed to define an air gap over an approximately entire surface thereof, each member was prepared in the same manner as that for the Example 3, and formed in the structure illustrated in FIG. 30.

Figure 31:
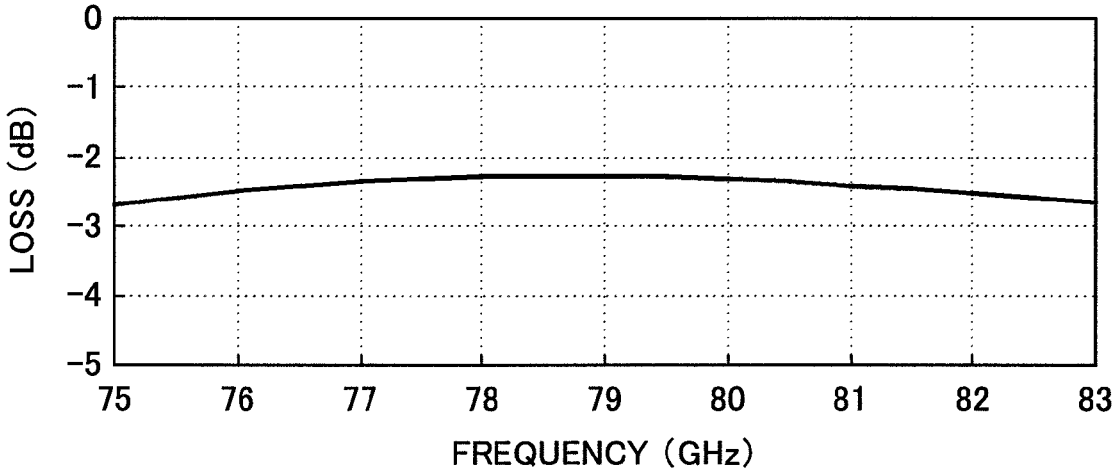
FIG. 31 illustrates characteristics of the planar array antenna in Comparative Example 2.

A transmission loss between the feed segment and the first patch pattern of this planar array antenna was analyzed using a high-frequency three-dimensional electromagnetic field simulator HFSS (trade name; produced by Ansoft Corporation). The result is shown in FIG. 31. In the entire frequency band 75 to 83 GHz, the transmission loss had an extremely high value of −2 dB or more.

EXPLANATION OF CODES

01: first ground conductor
02: second ground conductor
03: third ground conductor
04*a*: first dielectric
04*b*: second dielectric
04*c*: third dielectric
04*d*: fourth dielectric
05*a*: input end
06: first feed substrate
07*a*: fifth dielectric
07*b*: sixth dielectric
08: second feeder line
08*a*, 08*b*: output end
09: second feed substrate
010*a*: first shield spacer
010*b*: second shield spacer
011*a*: third shield spacer
011*b*: fourth shield spacer
012*a*: first patch pattern
012*b*: second patch pattern
013: first slit
014: second slit
0101: transformation line
0102: matching point
0103: gap
011, 101: antenna
002: transmission line section
102: feeder line section
1: planar array antenna
103, 303, 403, 503, 903, 1103: feed segment
42, 104, 304, 404, 504: feeder line
1041: the center line of the overlap region between feeder line and slit on feeder line
41, 105, 305, 405, 505: radiation element
106, 306, 406: first dielectric
43: first connection portion
52: second connection portion
24: second slot
108: metal zone
307, 407, 507: slit
308, 408, 508: first ground conductor
110, 310, 410, 510: first patch pattern

111, 311, 411, 511: transmission line
112, 312, 412, 512: second patch pattern
40, 130, 330, 430, 530, 530': antenna substrate
131, 331, 431, 531, 531': transmission line substrate
123, 323, 423, 523: second ground conductor
315, 415, 515: slot opening
316, 416, 516: hollow portion
120, 320, 420, 520: first shield spacer
318, 418: second dielectric
121, 321, 421, 521: second shield spacer
517: third shield spacer
519: fourth shield spacer
314, 414, 514: third ground conductor
124, 324, 424, 524: waveguide opening

What is claimed is:

1. A triplate line inter-layer connector having an electrical connection structure between a first triplate line in which a first feed substrate provided with a first feeder line and sandwiched between a first dielectric and a second dielectric is located approximately intermediate between a first ground conductor and a second ground conductor, and a second triplate line in which a second feed substrate provided with a second feeder line and sandwiched between a third dielectric and a fourth dielectric is located approximately intermediate between the second ground conductor and a third ground conductor, wherein:

the first feeder line is provided on the first feed substrate to extend from an input end thereof at an edge of the first feed substrate to a first patch pattern which is formed at a connection-side terminal end of the first feeder line;

the first feed substrate has a first shield spacer disposed therebeneath, and a second shield spacer disposed just thereabove, each of the first shield spacer and the second shield spacer having a hollow portion hollowed out to a size encompassing the first feeder line and the first patch pattern so as to define a corresponding one of the first dielectric and the second dielectric in a respective one of the positions beneath and just above the first feed substrate;

the first feed substrate is a polymide film having a thickness of 100 μm or less;

each of the first dielectric and the second dielectric has a thickness of 0.3 λg, λg being the effective wavelength at an operating frequency;

the second feeder line is provided on the second feed substrate together with a second patch pattern to extend in two directions from the second patch pattern to respective two output ends of the second feeder line; and the second ground conductor has a first slit formed in a portion thereof located approximately intermediate between the first patch pattern and the second patch pattern, and wherein:

the first slit is configured such that a longitudinal direction thereof becomes approximately perpendicular to a longitudinal direction of the second patch pattern; and the hollow portion of the first shield spacer, the second patch pattern, the hollow portion of the second shield spacer, the first slit and the second patch pattern have an overlap region, when viewed from the side of the third ground conductor in a layered direction of the first and second triplate lines.

2. The triplate line inter-layer connector as defined in claim 1, further comprising:

a third shield spacer and a fourth shield spacer disposed to allow the third dielectric and the fourth dielectric to be located at respective positions beneath and just above the second feeder line and the second patch pattern, each of the third shield spacer and the fourth shield spacer being adapted to define a dielectric which has a size encompassing the second feeder line and the second patch pattern and extends between opposite ends in a line direction of the second feeder line.

3. The triplate line inter-layer connector as defined in claim 1, wherein:

the first patch pattern has, in a line direction of the associated feeder line, a length L1 which is about ¼ to ½ times an effective wavelength λg at an operating frequency;

a part of the hollow portion hollowed out to a size encompassing the first patch pattern, in each of the first shield spacer and the second shield spacer, has, in a line direction of the associated feeder line, a length L2 which is 0.6 times the effective wavelength λg at the operating frequency;

the second patch pattern has, in a line direction of the associated feeder line, a length L3 which is 0.35 to 0.5 times the effective wavelength λg at the operating frequency; and the first slit has, in a direction perpendicular to the longitudinal direction of the second patch pattern, a length LS4 which is 0.4 to 0.6 times greater than the effective wavelength λg at the operating frequency.

4. The triplate line inter-layer connector as defined in claim 1, wherein:

the first patch pattern is formed in a circular shape having a diameter L4 which is ¼ to ½ times an effective wavelength $\lambda_g$ at an operating frequency; and a part of the hollow portion hollowed out to a size encompassing the first patch pattern, in each of the first shield spacer and the second shield spacer, is formed in a circular shape having a diameter L5 which is 0.6 times greater than the effective wavelength $\lambda_g$ at the operating frequency.

5. A planar array antenna having a multi-layer structure comprising an antenna section layer and a transmission line section layer, wherein:

the antenna section layer includes an antenna substrate and a first ground conductor having a slit, the antenna substrate having an antenna region which comprises a radiation element array consisting of a plurality of radiation elements arranged approximately in one line, and a feeder line connected to the respective radiation elements of the radiation element array; and the transmission line section layer includes a first shield spacer, a transmission line substrate, a second shield spacer and a second ground conductor, which are arranged in this order, the transmission line substrate having a transmission line, and a patch pattern formed at least one end of the transmission line to have a width greater than that of the transmission line, and wherein:

the feeder line, the slit and the patch pattern are provided at respective positions approximately corresponding to each other in a thickness wise direction of the planar array antenna;

respective shapes and positions of the slit and the feeder line are adjusted to satisfy the following relation: d1<d2, where d1 is a maximum distance of an overlap region between the slit and the feeder line in a longitudinal direction of the feeder line, and d2 is a distance between two straight lines which extend parallel to the longitudinal direction of the feeder line to sandwich the slit therebetween;

the patch pattern has, in the longitudinal direction of the feeder line, a length which is about ¼ to ½ of an effective wavelength ($\lambda_g$);

the first shield spacer has a hollow portion formed to surround the patch pattern so that the hollow portion is located away from the edge of the transmission line and the first patch pattern by a distance of 0.1-1.0 of the effective wavelength ($\lambda_g$); and the second shield spacer has a hollow portion formed in approximately the same shape as that of the hollow portion of the first shield spacer and at a position corresponding to the hollow portion of the first shield spacer.

6. The planar array antenna as defined in claim 5, which is configured such that, in an overlap region between the feeder line and the slit formed when viewed in the thicknesswise direction of the planar array antenna, the longitudinal direction of the feeder line becomes approximately perpendicular to a straight line connecting a1 and a2, where: a1 is a midpoint of a straight line which connects an intersection point e between a first one of opposite outer edges of the feeder line extending in the longitudinal direction thereof and a first one of opposite outer edges of the slit, and an intersection point f between the first outer edge of the feeder line and the other, second, outer edge of the slit; and a2 is a midpoint of a straight line which connects an intersection point h between the other, second, outer edge of the feeder line and the first outer edge of the slit, and an intersection point g between the second outer edge of the feeder line and the second outer edge of the slit.

7. The planar array antenna as defined in claim 5, wherein the overlap region between the feeder line and the slit is located in a position where the number of a first group of the radiation elements connected to the feeder line on one side of the overlap region becomes equal to the number of a second group of the radiation elements connected to the feeder line on the other side of the overlap region.

8. The planar array antenna as defined in claim 7, wherein the radiation elements are arranged to satisfy the following relation: b1+(a length equal to ½ of a wavelength λ at an operating frequency)≈b2, where: b1 is a length of the feeder line between a center point of the overlap region between the feeder line and the slit in the longitudinal direction of the feeder line and one of the first group of radiation elements located at the n-th position from the center point; and b2 is a length of the feeder line between the center point and one of the second group of radiation elements located at the n-th position from the center point.

9. The planar array antenna as defined in claim 5, which comprises a feed segment which is formed to have a width greater than that of the feeder line, and provided on the feeder line in the overlap region between the feeder line and the slit.

10. The planar array antenna as defined in claim 5, which comprises a second dielectric, and a third ground conductor having a slot opening larger than each of the radiation elements at a position corresponding to the radiation element array, the second dielectric and the third ground conductor being arranged in this order on the side of the radiation element array and the feeder line provided on the antenna substrate.

11. The planar array antenna as defined in claim 5, wherein the antenna substrate has a plurality of rows of the antenna regions.

12. The planar array antenna as defined in claim 11, which comprises third and fourth shield spacers provided at respective positions just above and beneath the antenna substrate having the rows of antenna regions, each of the third and fourth shield spacers having a plurality of hollow portions approximately corresponding to respective ones of the rows of antenna regions.

13. The planar array antenna as defined in claim 12, wherein the antenna substrate having the plurality of antenna regions has a metal zone provided between adjacent ones of the rows of antenna regions.

14. The planar array antenna as defined in claim 5, which comprises a first dielectric provided between the antenna substrate and the first ground conductor.

15. The planar array antenna as defined in claim 5, wherein the slit has a quadrangular shape or oval shape.

16. The planar array antenna as defined in claim 5, wherein the second shield spacer has a thickness approximately equal to that of the first shield spacer.

17. The planar array antenna as defined in claim 5, wherein the first shield spacer has a thickness greater than that of the patch pattern.

18. The planar array antenna as defined in claim 5, which is adapted to be used as a vehicle-mounted radar.

* * * * *